US007769544B2

(12) United States Patent
Blesener et al.

(10) Patent No.: US 7,769,544 B2
(45) Date of Patent: Aug. 3, 2010

(54) AUTONOMOUS VEHICLE RAILROAD CROSSING WARNING SYSTEM

(75) Inventors: James L. Blesener, Mahtomedi, MN (US); Gordon M. Melby, Blaine, MN (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 328 days.

(21) Appl. No.: 10/476,750

(22) PCT Filed: May 7, 2002

(86) PCT No.: PCT/US02/14390

§ 371 (c)(1),
(2), (4) Date: Jul. 22, 2004

(87) PCT Pub. No.: WO02/091013

PCT Pub. Date: Nov. 14, 2002

(65) Prior Publication Data

US 2004/0249571 A1 Dec. 9, 2004

Related U.S. Application Data

(60) Provisional application No. 60/289,320, filed on May 7, 2001.

(51) Int. Cl.
*G08G 1/16* (2006.01)
*G06F 17/00* (2006.01)
*G01C 21/00* (2006.01)

(52) U.S. Cl. ..... 701/301; 701/1; 701/19; 701/23; 701/200; 701/207; 701/213; 701/214; 701/215; 340/901; 340/902; 340/903; 340/904; 340/907; 340/693.1; 340/693.2; 340/693.3; 455/343.1; 455/343.2; 455/343.3; 455/343.4; 455/343.5; 455/343.6; 246/124; 246/125

(58) Field of Classification Search ..... 701/1, 701/19, 23, 200, 207, 213–215, 301; 340/901–907, 340/988, 693.1–693.3; 246/124, 125; 455/343.1–343.6
See application file for complete search history.

(56) References Cited

U.S. PATENT DOCUMENTS 4,723,737 A 2/1988 Mimoun (Continued)

FOREIGN PATENT DOCUMENTS

| | | | |
|---|---|---|---|
| JP | 11059419 | A | 3/1999 |
| WO | WO 99/09429 | A1 | 2/1999 |
| WO | WO 01/01587 | A3 | 1/2001 |

OTHER PUBLICATIONS

Canadian Application No. 2,446,545 Search Report dated Dec. 18, 2009.

*Primary Examiner*—Jack Keith
*Assistant Examiner*—Chuong P Nguyen
(74) *Attorney, Agent, or Firm*—Patterson Thuente Christensen Pedersen, P.A.

(57) ABSTRACT

An autonomous vehicle collision/crossing warning system provides for simple, inexpensive and decentralized installation, operation and maintenance of a reliable vehicle collision/crossing warning system. The autonomous warning system preferably utilizes a single frequency TDM radio communication network with GPS clock synchronization, time slot arbitration and connectionless UDP protocol to broadcast messages among vehicles and components in the warning system. Adaptive localized mapping of components of interest within the warning system eliminates the need for centralized databases or coordination and control systems and enables new vehicles and warning systems to be easily added to the system in a decentralized manner. Preferably, stationary warning systems are deployed as multiple self-powered units each equipped to receive broadcast messages and to communicate with the other units by a low power RF channel in a redundant Master-Slave configuration. The communication schemes are preferably arranged for low duty cycle operation to decrease power consumption.

10 Claims, 21 Drawing Sheets

U.S. PATENT DOCUMENTS 4,931,793 A * 6/1990 Fuhrmann et al. ..... 340/903
4,942,395 A 7/1990 Ferrari et al.
5,098,044 A 3/1992 Petit et al.
5,325,302 A 6/1994 Izidon et al.
5,420,883 A * 5/1995 Swensen et al. ..... 375/138
5,450,329 A 9/1995 Tanner
5,539,398 A 7/1996 Hall et al.
5,554,982 A 9/1996 Shirkey et al.
5,574,469 A 11/1996 Hsu
5,620,155 A * 4/1997 Michalek ..... 246/121
5,699,986 A * 12/1997 Welk ..... 246/125
5,729,213 A * 3/1998 Ferrari et al. ..... 340/901
5,739,768 A 4/1998 Lane et al.
5,757,291 A 5/1998 Kull
5,774,829 A * 6/1998 Cisneros et al. ..... 701/213
5,864,304 A * 1/1999 Gerszberg et al. ..... 340/903
5,872,526 A 2/1999 Tognazzini
5,890,682 A 4/1999 Welk
5,898,680 A * 4/1999 Johnstone et al. ..... 370/316
5,900,825 A 5/1999 Pressel et al.
5,926,117 A * 7/1999 Gunji et al. ..... 340/988
5,983,161 A * 11/1999 Lemelson et al. ..... 701/301
6,104,978 A * 8/2000 Harrison et al. ..... 701/207
6,122,514 A * 9/2000 Spaur et al. ..... 455/448
6,160,493 A 12/2000 Smith
6,179,252 B1 1/2001 Roop et al.
6,185,504 B1 2/2001 Berstis et al.
6,218,961 B1 4/2001 Gross et al.
6,301,545 B1 * 10/2001 Brodie ..... 701/213
6,317,058 B1 * 11/2001 Lemelson et al. ..... 340/910
6,340,139 B1 * 1/2002 Hilleary ..... 246/292
6,345,233 B1 2/2002 Erick
6,370,475 B1 4/2002 Breed et al.
6,611,755 B1 * 8/2003 Coffee et al. ..... 701/213
2001/0032908 A1 * 10/2001 Anderson et al. ..... 246/124
2002/0055817 A1 5/2002 Chou

* cited by examiner

TRANSCEIVER BLOCK DIAGRAM

150

400A

400B

Token Maximum, 1 header of 2 bytes & 10 Data Blocks of 18 bytes gives 182 bytes maxim. 1ms + 12ms + 10*62ms = 633ms

AUTONOMOUS VEHICLE RAILROAD CROSSING WARNING SYSTEM

RELATED APPLICATIONS

The present application claims priority from U.S. Provisional Application having Ser. No. 60/289,320, filed May 7, 2001, which is hereby incorporated by reference in its entirety.

FIELD OF THE INVENTION

The present invention relates generally to the field of vehicle collision/crossing warning systems. More particularly, the present invention relates to a relatively inexpensive, low-power vehicle collision/crossing warning system that enables simple and decentralized installation, operation, and maintenance of a reliable vehicle collision/crossing warning system.

BACKGROUND OF THE INVENTION

Railroad crossing warning systems are perhaps the most familiar of a variety of vehicle collision/crossing warning systems. The purpose of such warning systems is to notify vehicles and/or stationery warning indicators of the approach and/or proximity of a vehicle. Other examples of such warning systems include emergency vehicle traffic light override systems, automobile navigation systems, airport and construction zone vehicle tracking systems and other navigational control and warning systems.

Because of the safety importance of vehicle collision/crossing warning systems, reliability and failure free operation are critical requirements in the design of such a system. In order to meet these design requirements, most existing vehicle collision/crossing warning systems are relatively expensive and require some form of centralized or coordinated communication scheme among the vehicles and other components that are part of the warning system. In the case of stationery warning components, such as railroad crossing warning systems or traffic light intersections systems, installation of such warning systems can require significant effort and usually involves providing power and communication wiring as part of the installation.

Traditional railroad crossing warning systems, for example, have relied on the railroad tracks themselves to detect an approaching locomotive and activate a warning signal apparatus. As the wheels of an approaching locomotive pass by a detector positioned at a predetermined location along the tracks relative to the crossing, the detector senses an electrical short across the tracks and sends a signal to a controller that activates flashing lights and/or descending gates at the crossing. The expense of installing such a traditional railroad crossing warning system, coupled with the requirement for AC electrical power to operate the warning system, have limited the use of such warning systems to urban areas and other high volume traffic crossings.

One alternative to such hardwired collision/crossing warning systems involves the use of wireless transmitters and receivers. U.S. Pat. Nos. 4,723,737, 4,942,395, 5,098,044, 5,739,768 and 6,179,252 are examples of such systems. Another alternative involves the use of global positioning satellite (GPS) technology to identify the location and movement of vehicles within the system. Examples of warning systems that utilize GPS technology are described in U.S. Pat. Nos. 5,325,302, 5,450,329, 5,539,398, 5,554,982, 5,574,469, 5,620,155, 5,699,986, 5,757,291, 5,872,526, 5,900,825, 5,983,161, 6,160,493, 6,185,504 and 6,218,961, as well as PCT Publication Nos. WO9909429 and WO101587 and Japanese Abst. No. JP11059419. Generally, these alternatives rely on some type of centralized or coordinated communication scheme to keep track of multiple vehicles and components or to confirm transmission of messages between vehicles and components within the warning system.

Despite these developments, there continues to be a need for a relatively inexpensive, low-power vehicle collision/crossing warning system that enables simple and decentralized installation, operation, and maintenance of a reliable vehicle collision/crossing warning system.

SUMMARY OF THE INVENTION

The present invention is an autonomous vehicle collision/crossing warning system that provides for simple, inexpensive and decentralized installation, operation, and maintenance of a reliable vehicle collision/crossing warning system. The autonomous warning system preferably utilizes a single frequency TDM radio communication network with GPS clock synchronization, time slot arbitration and connectionless UDP protocol to broadcast messages to all vehicles and components in the warning system. Adaptive localized mapping of components of interest within the warning system eliminates the need for centralized databases or coordination and control systems and enables new vehicles and warning systems to be easily added to the system in a decentralized manner. Preferably, stationary warning systems are deployed as multiple self-powered units each equipped to receive broadcast messages and to communicate with the other units by a low power RF channel in a redundant Master-Slave configuration. The communication schemes are preferably arranged for low duty cycle operation to decrease power consumption.

A preferred embodiment of the present invention is directed to a railroad crossing warning system that is low-cost and well-suited for use with low volume highway-rail intersections. The autonomous railroad crossing warning system in accordance with this embodiment includes a tracking device, such as a GPS receiver to calculate the position, velocity, and heading of a locomotive. A GPS receiver is also provided at each railroad crossing to provide the location of the crossing to both passing locomotives and other crossings. The present invention also includes at least one communication device on each locomotive and at each crossing that provides an autonomous single-frequency radio network utilizing time division multiplexed communication and synchronizes the radios with the GPS time clock. Synchronization between transmitting and receiving of the radios on the network allows reduced power consumption by the receivers. A communication protocol is used to ensure proper channel hopping and eliminate data collisions, which allows multiple devices to use one radio frequency. Software is provided at each railroad crossing to calculate locomotive arrival time at the crossing based on GPS data received through the radio network from the locomotive and activate the motorist warning devices at appropriate times. The software supports multiple locomotives in the vicinity of the crossing and screens out locomotives that are on different courses and will not intersect the crossing. The two-way communication between locomotives and crossings will allow system status data from each crossing to be collected by passing locomotives and, if a crossing warning system is completely inoperable, automatically issuing a mayday broadcast to be received by passing vehicles and, optionally, having the passing locomotive telephone a centralized computer system with the location of the failure through a cellular phone on the locomotive. Preferably, data collection on the status and condition of the warning system is distributively collected by each locomotive. A handheld display/keyboard preferably is used to alert locomotive operators to upcoming crossings and also is used to enter locomotive length for purposes of broadcasting this information.

The present invention preferably includes an autonomous locomotive detection system that does not impinge on the railroad right of way. In one embodiment of the present invention, low frequency seismic sensors are used to awaken the control system at each railroad crossing when a locomotive approaches within a certain distance of the crossing. Additional dual ultrasonic sensors may be used to monitor for the presence of components in the crossing, as well as when the locomotive has left the crossing. In another embodiment, dual magnetometers are used to monitor for presence of locomotives in or near the crossing. Another element of the present invention is the design allows for the use of solar power to provide all system power needs at railroad crossings. Preferably, all of the hardware required for the crossing warning system is mounted on the existing cross buck posts or railroad ahead warning signs so that additional site construction is minimized.

One feature of a preferred embodiment of the present invention is a self-adaptive mapping algorithm that generates micro maps for each subsystem. The subsystems communicate with devices passing through their immediate environment and learn of other components in their environment and teach the passing devices information it does not know. This self-propagating algorithm eliminates the need for a Master map at each subsystem. Passing devices generate Master maps that automatically update when passing through subsystems and teach subsystems of new components in their environment, thereby allowing passing vehicles to learn of upcoming components in the immediate environment.

A feature of the communication scheme of the present invention provides for a dual RF arrangement having broadcast cells surrounding each component in the warning system having a radius of at least about 0.25 miles preferably using 2 W transmitters and local zones surrounding each units in a stationary warning system having a radius of less than about 0.25 miles preferably using 100 mW transmitters. The local zone network preferably is synchronized by the Master unit with periodic GPS time stamps such that fewer GPS operations are required by the Slave units. The dual RF cellular arrangement with the arbitrated UDP (user datedgram protocol) communication scheme allows for vehicles to seamlessly join and leave cells as the move across stationary warning systems. In an alternate embodiment, vehicles can be equipped with collision avoidance software and systems to inform moving vehicles of impending collisions with other vehicles. In one embodiment, software in stationary devices makes decisions based upon analysis of the broadcast information to determine potential relevance and estimated arrival times of vehicles within a corresponding cell. In a preferred embodiment, the local zone network utilizes phase and amplitude analysis of broadcast signals received by each of the units to differentiate valid locomotive broadcasts from extraneous triggers.

In a preferred embodiment of the application of a railroad crossing warning system, each locomotive is provided with a tracking (GPS) device on the locomotive to calculate position, speed and heading. Each crossing is also provided with a tracking (GPS) device to calculate at least an initial position and to establish clock synchronization. The communication scheme between the locomotive and the crossing preferably allows for 2-way communication but does not require handshake, acknowledgements or complete reception of all broadcasts in order to function properly. Preferably, multiple transceivers at the crossing provide 2+ levels of redundancy.

DETAILED DESCRIPTION OF PREFERRED EMBODIMENT

Figure 1:
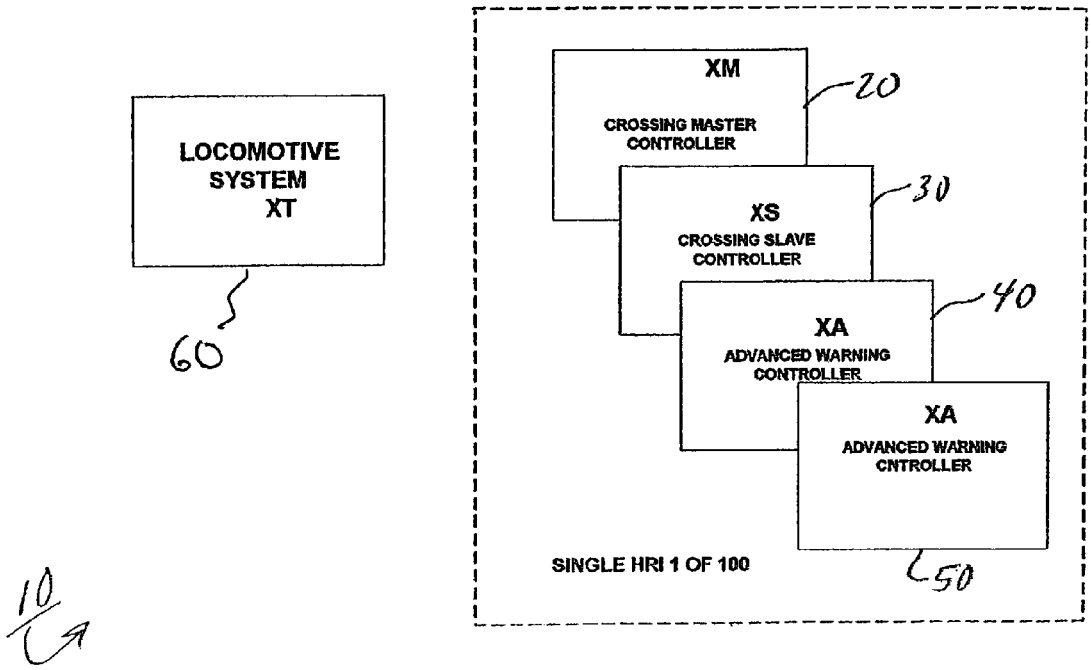
FIG. 1 is a block diagram of a vehicle warning system 10 according to the present invention.

The present invention provides an autonomous vehicle collision/crossing warning system that is both low cost and highly reliable. For purposes of the present invention, it will be understood that the purpose of such warning systems is to notify vehicles and/or stationery objects such as warning indicators of the approach and/or proximity of a vehicle. Examples of such warning systems include railroad crossing warning systems, emergency vehicle traffic light override systems, automobile navigation systems, airport and construction zone vehicle tracking systems and other navigational control and warning systems. The present invention is applicable to a wide variety of vehicles, including trains, automobiles, trucks, boats, ships and any other mobile land or water craft. The present invention may also be used with a wide variety of stationary objects, such a warning systems, traffic lights, traffic control devices and the like. Because of the uniform regulation, high rate of speed and operation in three dimensions, the present invention is not suited for use as a vehicle warning system for aircraft. While the preferred embodiment of the present invention will be described with respect to a highway-rail intersection system, it will be understood that the warning system of the present invention is equally applicable to any of the warning systems or vehicles just described.

The highway-rail intersection warning system of the present invention is self-contained, powered by solar cells with battery backup, and does not require costly phone line or power installations. Components of the warning system include built in safety redundancy capabilities to ensure continuous operation in case an advanced warning sign or a cross-buck sign were damaged in an accident. The remaining functional devices would provide notification of a problem to a fault notification center, and to the next intersection, informing them that two intersection components at a "damaged" intersection were no longer operational. If all four units of a typical installation were damaged the smart Self Updating adaptive mapping system in the locomotive would notify the engineer and the fault notification center.

An advantage to the present invention is that Time Division Multiple (or Multiplexed) Access (TDMA) communications are used in the control system, which permits several devices, such as the locomotive, crossing, and advanced warning devices, to share a common radio frequency without interfering with each other. In addition, instead of having a master network controller such as cell site tower, the warning system of the present invention uses precision timing derived from the GPS satellite system and pre-assigned timeslots for specific device communications activities. In this manner, for example, up to 8 locomotives can communicate with an individual intersection without interfering with each other. Timeslots and maintenance of precision timing lets the system operate without a Master Network controller as is used in prior art systems.

Figure 2:
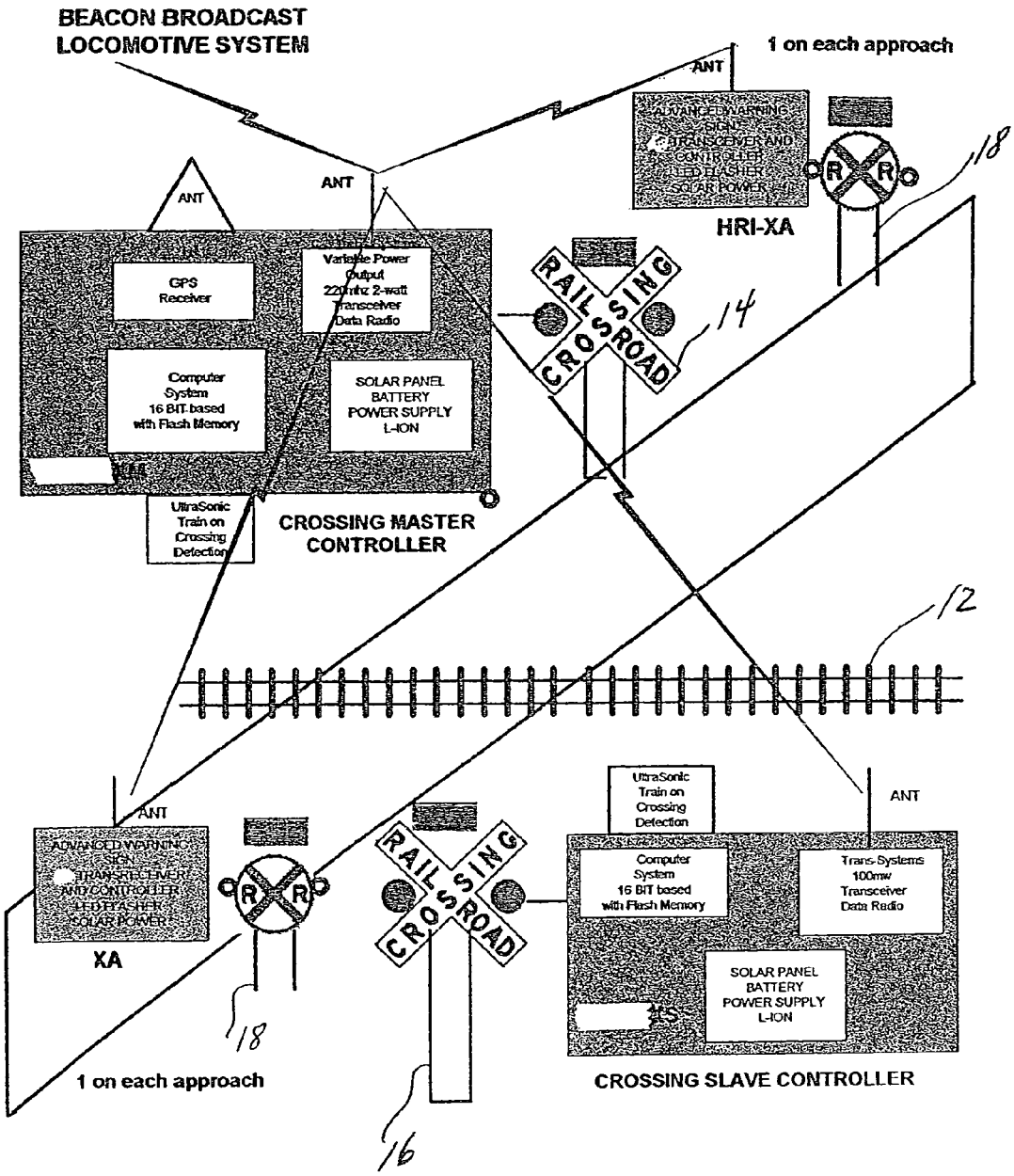
FIG. 2 is diagram illustrating the vehicle warning system located at a railroad crossing.

FIGS. 1 and 2 illustrate one embodiment of a vehicle warning system 10 according to the present invention. In this example embodiment, system 10 includes a master control system or controller 20 (located on one side of a railroad track or intersection 12), a slave control system or controller 30 (located on the other side of track 12 opposite master controller 20), and two advanced warning control system or controllers 40 and 50 (located on opposite sides of track 12). System 10 further includes a vehicle control system or controller 60 that is located on a moving vehicle (in this example, a locomotive). Master controller 20 controls the communications between itself and the crossing slave units (e.g., controllers 30, 40 and 50). Controller 20 includes a GPS (global positioning system) receiver and provides the primary listening communications link to the vehicle controller (e.g., vehicle controller arrangement 60). Controller 20 is mounted on a cross-buck 14 and includes solar power cells, batteries, and dual double sided LED lights for optimum visibility to motorists approaching the intersection. In this example, controller 20 houses the crossing GPS and one of two ultra-sonic locomotive detection sensors, which are used to validate that the crossing is occupied by a railcar or any other vehicle, or if the crossing is clear.

Slave controller 30 is mounted on cross-buck 16 and includes most of the components that are in the master controller except for the GPS receiver. Both controllers have ultra-sonic locomotive detection sensors that "PING" and analyze the returned echo to establish the status of the crossing or to time the locomotive entrance and exit from the crossing for evaluation purposes. The sensors may also be used to determine, in conjunction with the precision navigation system on the locomotive, where the actual end of locomotive is, i.e. real length of locomotive. In a related embodiment, the ultra-sonic locomotive detectors can be substituted with magnetometer sensors. This embodiment will be discussed in detail later in the specification.

Advanced warning controllers 40 and 50 include most of the components that are in the slave controller except for the advanced warning sensors (e.g., ultra-sonic or magnetometer sensors). To conserve power, controllers 40 and 50 "SLEEP" most of the time and are awakened at periodic intervals to be told a locomotive or a vehicle is approaching the intersection or crossing and to stay awake during activation. Two advanced warning controllers are used and are installed on each side of the track on advanced railroad warning signs 18 to warn drivers that they are approaching a railroad crossing or intersection. Controllers 40 and 50 depend on a timeslot strategy that is used by the entire warning system 10 to conserve energy. All crossing devices maintain time synchronization to a GPS derived clock of controller 20. This ensures accurate timeslot management by all devices system 10. System 10 further includes a locomotive (or vehicle) controller 60 used by any locomotive crossing the intersection.

System 10 "wakes up", when a locomotive is approaching from either direction, and provides a warning 30-seconds before the locomotive arrives at the intersection. The early advance warning is intended to provide drivers with enough time to take appropriate action. System 10 will continue flashing until after the locomotive has passed and all railcars have cleared the intersection. In the event that one of the signs has been damaged in an accident, the other signs will still continue to operate providing their advanced warning. A system problem message will be forwarded to a fault notification center.

Figure 3:
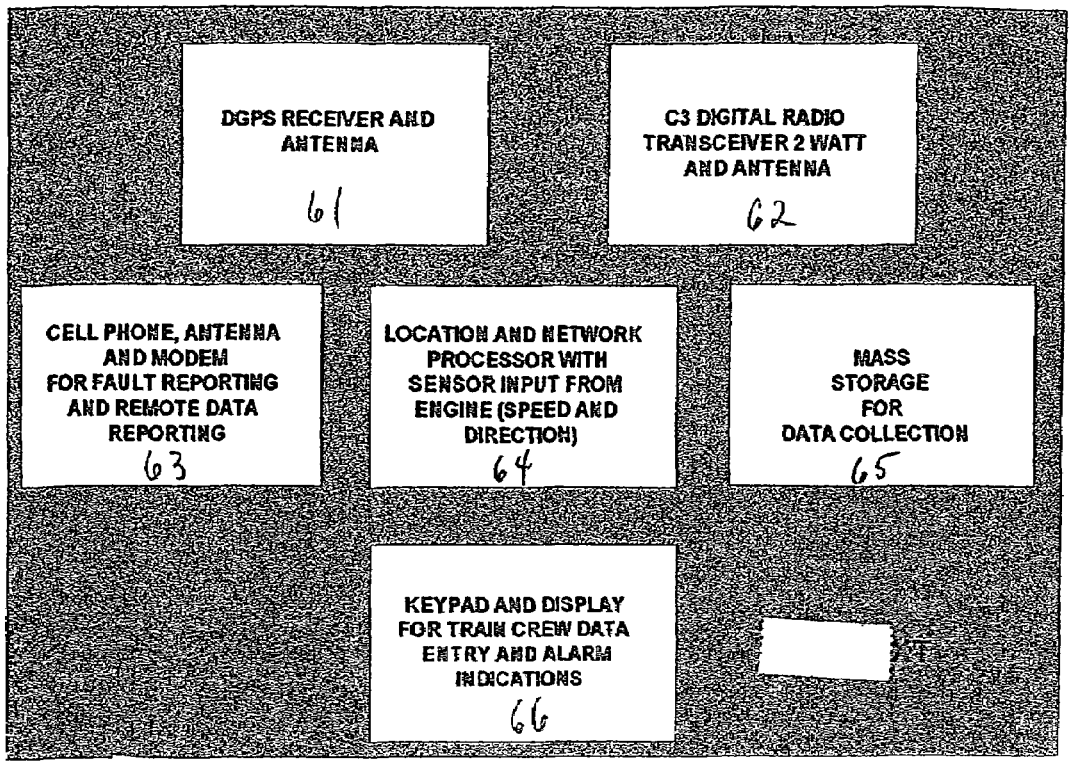
FIG. 3 is a block diagram of the locomotive communications control system that operates within a warning system of the present invention.

In one example embodiment, the Railroad engineer/conductor will have available a handheld (or systems mounted) Locomotive Data Entry and Display module (FIG. 3). As the locomotive approaches within 30 seconds of entering the warning system equipped highway-rail intersection, system 10 communicates with the intersection and activates the intersection. The engineer receives a system-activated notice, or in case of problems (for example damage to one of the signs equipped with a controller) the Data Display unit will notify the engineer of the problem. It will also notify the fault notification center via cell phone of the problem. As the locomotive approaches the intersection, the advance warning and cross-buck signs will have been activated and flashing warnings to motorists. The Data Entry module is also used to enter the number of cars for locomotive length in backing situations.

System 10 also uses a Smart Self Updating System (SSUS) to poll the crossing and share the latest systems information. In this way, as the locomotive moves down the track it is also updating itself and all crossings along the line with the latest system information. Using the SSUS will require no input on the locomotive engineers part. Furthermore, a locomotive equipped with a controller 60 including SSUS, does not need to be programmed by the engineer. System 10 receives all its updated system information from the first intersection it approaches. At this time it will know what to expect as it continues down line. This information will be useful at times when all system 10 components at one of the equipped intersections has been damaged. This event of total system failure of all components at an intersection will be known by the approaching locomotive equipped with controller 60. The engineer will be notified as well as the fault notification center. System 10 will in turn pass this information along to the next intersection, and thereby all locomotives approaching the intersections it has passed. Only, when the locomotive is backing, and there will be a significant number of new of railcars aided to the locomotive, will the engineer need to update system 10 with the total number of cars. In this example embodiment, as the last car of the locomotive exits the intersection the flashing lights will be deactivated and the system will wait for the next locomotive to approach.

Each locomotive SSUS contains a database of the status of all known crossings and each crossing controller has a copy of a smaller localized database. Each time a locomotive and crossing interact, the databases are compared and whoever has the latest information, passes this data to the other. In this manner, locomotives will have the most up to date status of the system. To achieve the high reliability in this system, any of system 10 components could communicate with the locomotive in the event of a Master controller failure. If a locomotive is new to an intersection it will have learned of that intersection from the previous intersection. In the event of a total system 10 failure (from vandalism or an act of God) the locomotive will have prior warning of the problem, giving a warning to the engineer and providing notification to the fault notification center. Locomotives, as they travel the system, will receive notifications from partially failed crossings through the MAYDAY broadcasts. As a result a locomotive, with a new advanced warning system can enter its first system 10 equipped highway intersection and receive the latest system updates for all the warning systems in that area. This information is then propagated from locomotive to the warning system, and vise-versa as required.

In this example embodiment, system 10 uses the locomotive as a platform for a BEACON signal that is transmitted every 4 seconds in a timeslot. The BEACON contains geographic location information about the locomotives position, speed, direction of locomotive motion and heading. This information is obtained from a precision DGPS (differential) receiver on the locomotive. Any crossing can listen to any locomotive at all times, if the locomotive is within radio range of the crossing.

The decision process to activate the signal and the advanced warning indicators is made at the crossing by master controller 20. Controller 20 contains a powerful 16 bit microcomputer (and DGPS and transmitter) that compares its location, derived from it's onboard DGPS receiver, to that of the locomotive data derived from the BEACON transmission and decides if the locomotive is approaching the crossing and activation needs to occur. Once activation has occurred master controller 20 can optionally notify the locomotive that the crossing is activated. Master controller 20 also controls the other warning devices in system 10 and collects information about the state of each device such as the battery and whether a self-test of on-board devices was successful. As the locomotive enters the crossing, a set of ultra-sonic sensors connected to master controller 20 and another set connected to slave controller 30 confirms the crossing. Master controller 20 also deactivates the crossing when the locomotive has passed. The same sensors are used for locomotive cars left on the crossing.

One of the advantages to the present invention is that any of the controllers disposed on the crossing posts can operate as the master controller in the event master controller 20 fails. Because system 10 maintains a continuous dialogue between devices, the devices can very quickly detect abnormal behaviors and respond with a call for help, referred to as a MAYDAY. Any crossing device can initiate a MAYDAY. This transmission is made anytime a locomotive is in listening range to the crossing even if the locomotive will never intersect the crossing. This ensures prompt reporting of failed crossing devices due to the immediate call the locomotive controller 60 places to the fault notification center.

Preferably, all crossing system components mount on existing structures with no addition construction required in most instances. In this example embodiment, all crossing devices are totally self-contained and mount as a single unit. All crossing components use extremely long life Lithium Ion battery technology, combined with a high efficiency solar panel. The battery pack is designed to provide 5 full days of operation with minimal solar input. The battery pack uses state of the art long life, low temperature operation AGM (Absorbed Glass Mat) Sealed Lead Acid (e.g., Concord SunXtender PVX1234T battery). The overall crossing system design allows most active components to "SLEEP" in an inactive state and be awakened based on the Timeslot communications scheme to be described later. This allows for extremely low power drain on the system, permitting smaller batteries, and solar panels. Each station or location at the crossing is totally self contained such that no wiring or construction is needed to install the system.

FIG. 3 illustrates the locomotive control system or controller 60 that includes: a DGPS receiver 61, a digital radio 62, a cell phone and modem 63, a processor 64, a mass storage device 65, and a key pad and display 66.

A locomotive equipped with controller 60 and a crossing with master controller 20 has GPS location data on board. This data allows the system to know about the devices by geo-location. Knowing about the location of a crossing and knowing where the locomotive is, the system can cross check if it is approaching a crossing and has not gotten a confirmation that the crossing is activated. This is the fail-safe for a totally broken crossing. In system 10, if the locomotive knows about a crossing, it cannot forecast that it should have received a confirmation and warn the engineer. Typically the locomotive does not need to know there is a crossing ahead because, if the crossing is working, the locomotive beacon will cause it to activate. When the crossing activates, it sends geo-location data to the locomotive, which causes the locomotive to "discover" the presence of the crossing. This discovery process causes the locomotive to learn about this "new" crossing. Data about the new crossing is placed in the locomotives' database.

Using SSUS the locomotive will now propagate this new knowledge throughout the system by passing along this information to each crossing it encounters. Crossings store in memory only data within a given grid size whereas locomotives store in memory everything. As the system is used, information will propagate and update automatically. Locomotives new to the area require no prior engineer operation and interface. Locomotives will learn what is ahead from any functional warning system 10 it encounters thus protecting itself from the unusual event of total warning system 10 failure at any crossing. Locomotives can share this data with others and accurate maps of working intersections can be automatically generated. Locomotives also time stamp this information so that passage time, activation time, location and deactivation time, and location are stored for system performance evaluation. The locomotive uses DGPS 61 so this information is accurate to several feet.

Database 65 of the locomotive controller 60 contains the geo-location and track direction through the crossing. The Master controller at the crossing knows its location from its own on-board GPS, so as soon as a new crossing is turned on it has this data with no human intervention. This is stored as 4 bytes for milli-arc-seconds of latitude, 4 bytes for milli-arc-seconds of longitude and two bytes indicating compass direction of the rails through the crossing. In the last two bytes the crossing status is also encoded. It has been estimated that there 260,000 crossings in the US, therefore to store the entire US crossing database requires less that 3 megabytes of flash memory in the locomotive while the crossings will only store a localized map of their individual surroundings.

In the example of a new locomotive entering the warning system and encountering its first crossing, it is impractical for the locomotive controller 60 to download all 3 megabytes of data from the crossing at a rate of 4800 band. Therefore, the warning system uses to its advantage the fact that the locomotive cannot be in California and Maine at the same time. In this example, the locomotive is in Minnesota, so only data that is within a grid of one degree by one degree, is actual exchanged during the dialogue. This would typically be less than a few hundred crossings. As the locomotive progress towards California, and through system 10 equipped crossings, it will continue to compare its database using a Cyclic Redundancy Check (CRC) of its database for a given grid or area with the same CRC from the crossing it is passing. If they match, the databases are the same and no update is needed, if they differ then they exchange the latest data during passage.

Preferably, data is stored in the crossings based on a 1 degree, which is approximately 60 NM by 60 NM or a 69 by 69 statute mile grid. The crossing data has the crossing in the center of the grid. The locomotive receives the location of the crossing and uses this location to generate a CRC on the same grid data and then compares this with the CRC sent from the crossing. If the databases match, no exchange occurs, if not then an update exchange takes place based on the latest data. The latest data is determined by comparing all locomotive time stamped entries with-in the prescribed grid with the database time stamp from the crossing. The device with the latest data sends this data to the other.

The system architecture of system 10 is based on a Time Division Multiple Access (TDMA) wireless communications system using a dedicated radio frequency for transmission of data between the locomotive(s) and crossing(s) (see FIGS. 1 and 2). System 10 uses precision Differential Global Positioning System (DGPS) navigation methods to determine distance of the locomotive or locomotive from an individual crossing. All arrival and departure calculations are done at the individual crossing sites. The locomotive's controller 60 is primarily responsible for generating a BEACON broadcast used in the crossing arrival and departure calculations. The BEACON conveys latitude, longitude, heading, speed, length and backing status. Locomotive controller 60 is also responsible for collecting and storing status data from working crossings and relaying fault notifications from failed crossing. The system 10 architecture makes optimum use of power, hardware and communications bandwidth to provide a safer more effective system for advanced warning activation. The use of DGPS provides precise location of locomotives and precision timing for communications. The System also uses the number of locomotive cars to compute end of locomotive location relative to the crossing.

Precision DGPS timing is used to synchronize controller 20 intersection radio network and provide for TDMA (Time Division Multiple Access) control of communications within warning system 10. Preferably, all field devices use TDMA and the radio network to allow for minimum power consumption through the use of a concept referred to as "SLEEP". The concept of "SLEEP" permits devices to essentially go into "hibernation" and consume very low power, then awaken at appropriate times to respond to communications from other devices. The SLEEP architecture permits very economical implementation of battery and solar power systems for field devices and lowers installation costs. In this embodiment, system 10 uses solar cells manufactured by Solarex (model SX-30), which are a multi-crystal solar electric cell that provides photovoltaic power for general use. They operate DC loads directly or, in an inverter-equipped system, AC loads.

Referring again to FIG. 3, DGPS receiver 61 operates in a DGPS mode to provide <5 meter RMS fixes on location. The radio system 62 provides for beacon broadcasts to all warning system 10 equipped crossings and receives information from crossings. Processor 64 provides control of radio communications, generates position information and logs data for system performance evaluation. The Engine interface to the processor provides accurate low velocity locomotive position data for use in dead reckoning. A keypad and display provides a means for the locomotive crews to monitor the system and enter data about the locomotive such as number of cars, as needed. Cell phone modem 63 is used to report system faults and for doing data collection remotely.

Controller 60 controls the transmission of beacons to surrounding warning system 10 crossings by using precise DGPS derived timing to transmit these beacons and network status data at the correct time interval or timeslot. The crossings listen in appropriate timeslots for controller 60 beacon broadcasts. The timeslot control also ensures that the beacon of controller 60 does not unintentionally interfere with local crossing system communications, as the crossing system communicates within itself during a different time interval than the beacon broadcast from controller 60. Preferably, all warning system 10 controllers have built in diagnostics to verify that the flashers work and the status of the batteries are known at all times for all devices.

Figure 4:
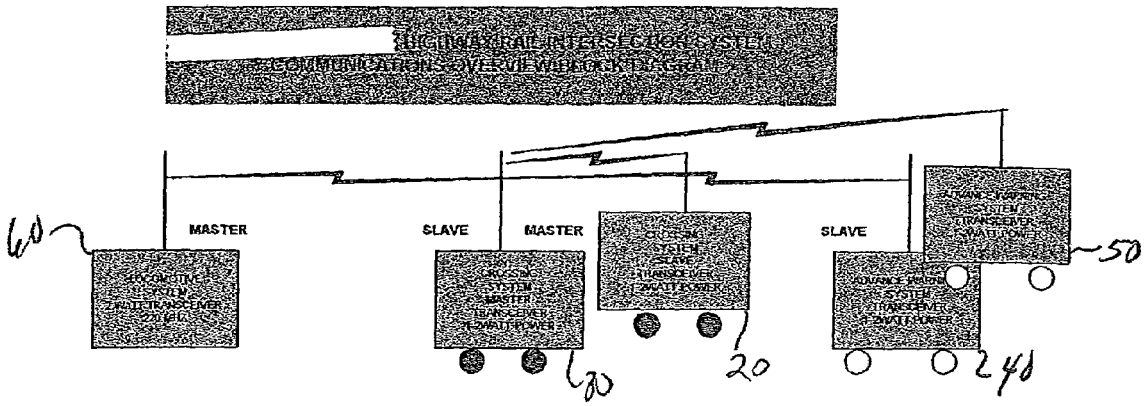
FIG. 4 is a block diagram that illustrates the interaction of a locomotive with a master controller and the controllers of a warning system located at a railroad crossing.

FIG. 4 illustrates how the locomotive with controller 60 interacts via messaging with the controllers located at a crossing (or intersection). Upon approach of a locomotive, the crossing controllers wake up and remain in a state of alert until the locomotive has passed. The timeslot strategy ensures that a wakeup cycle occurs every 4 seconds corresponding to the locomotive beacon transmission. The speed of the locomotive and the distance at which the radio network communicates gives a several minute margin between locomotive controller 60 wake up and the crossing activation. In this example embodiment, controller 60 messages to the crossing, using 2 watts of power, speed and position data via the beacon; or an acknowledgement or uploads data. At low power, the locomotive receives messages: crossing activated/deactivated; upload data; or MAYDAY signal. At the crossing, messages received include: enter standby mode; activate warning and provide acknowledgement or deactivate warning and acknowledge.

Any non-functioning crossing device(s) are detected and an alarm is sent in a special timeslot called the MAYDAY mode. Each of the controllers of system 10 are capable of acting as MAYDAY senders in the event of a detected crossing failure. Loss of master controller 20 is detectable by any of the crossing slave controllers or the advanced warning controllers because of periodic polling between master and slave devices. If the Slave devices detect a number of missed polls by their master 20, they will enter a MAYDAY mode in which they will take turns, to maximize battery life, sending the MAYDAY broadcast to any locomotives in the area. All remaining slave units will continue to function, and any remaining device can control the intersection. In the event the Master controller containing the GPS fails, slave devices will resynchronize their time-base communications by using locomotive controller 60 and its beacon derived timing allowing proper timeslot operation. This feature ensures that faults get reported as soon as possible, even if the locomotive detecting the MAYDAY broadcast is not dealing with the failed intersection. The MAYDAY is sent on a higher power, i.e. 2 watts to ensure maximum range. Further, the MAYDAY is only active during times the warning system 10 at the crossing hears a beacon broadcast from a locomotive. MAYDAY broadcasts include geo-location data of the failed crossing. This information is then relayed via the cell phone modem in the locomotive to the designated responders. Systems 10 use 1 narrow band FM channel in the VHF or UHF band. This is a licensed frequency with a power of 2 watts. All transmitters are considered mobile units. System 10 uses 2 watts for locomotive BEACON broadcasts and 100 mw for crossing intercommunications. Crossings preferably use 2 watts for MAYDAY transmissions when attempting to notify a nearby locomotive. Multiple transmitters are managed through the use of a TDMA control scheme using DGPS timing corrections for network synchronization.

Figure 5A:
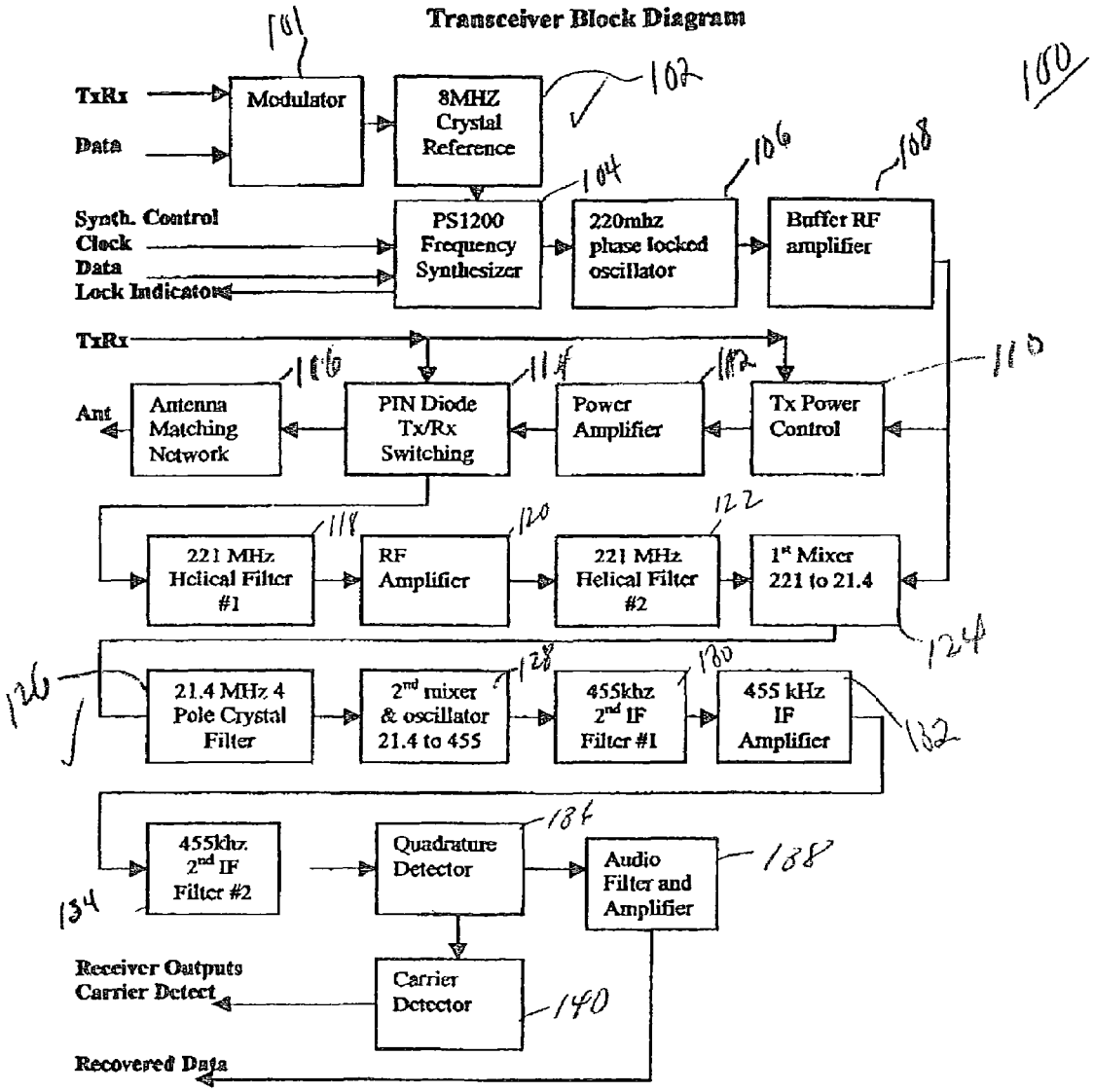
FIG. 5A illustrates a block diagram of the transceiver that forms a part of the control system of the warning system of the present invention.
Figure 5B:
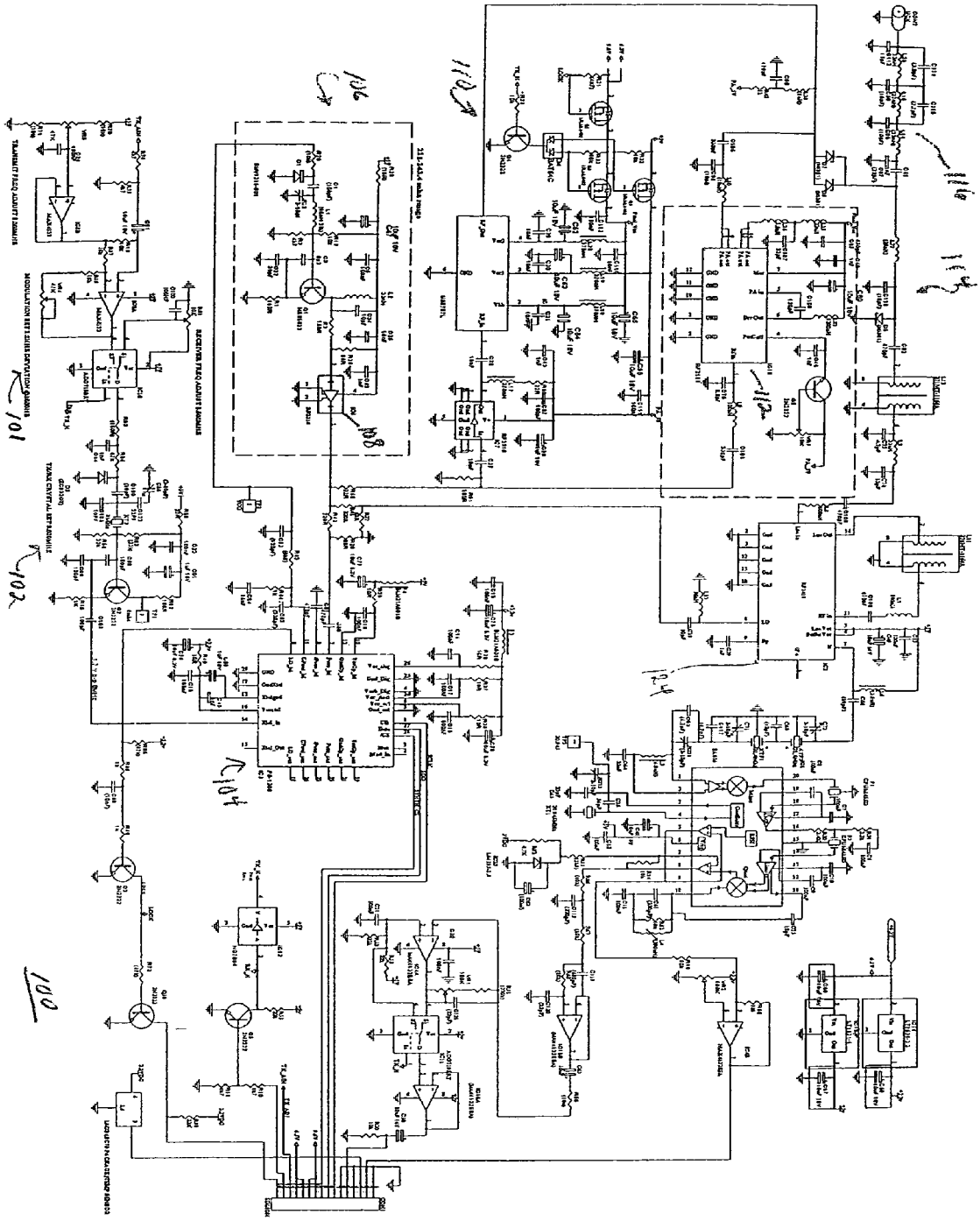
FIG. 5B illustrates the schematic diagram of the transceiver of FIG. 5A.

Referring now to FIGS. 5A and 5B, a block, diagram and a schematic diagram illustrate, respectively, a preferred embodiment of a transceiver that is used in system 10. System 10 communications are based on the use of a narrow band (5 KHz channel) FM radio system and uses GMSK FM modulation to transmit at 4800 BPS data rates. The 8 MHz oscillator 102 is composed of Q2, Xt2, D2, C100, C122, C34, C98, C99 and resistors R46, R63 and R67 (see FIG. 5B). This is a modified Clapp oscillator, with varactor diode D2 being the tuning element. Application of a DC voltage will cause D2 to decrease its capacitance, which in turn causes crystal XT2 to shift its frequency upward. With no modulation applied capacitor C122 is adjusted for exactly 8 Mhz oscillator frequency.

The modulator 101 is composed of CMOS Switch IC-10 that connects the varactor diode to either the Receiver Frequency Adjust Pot R81 or to the Modulation source from the output of IC8A-pin 1. The choice of inputs to the varactor diode is determined by the TX/RX signal at pin 1 of IC-10. Pot VR6 adjusts the modulator DC level to provide 8 MHz output from crystal with no AC modulation applied. The modulated or static 8 MHz frequency signal is applied to Synthesizer (104) IC-3. This 8 MHz frequency is divided internally by synthesizer 104 to obtain a 4 MHz reference frequency. This reference is compared to the output of the VCO signal from IC6 pin 5, when in the transmit mode, should be 221.9525 MHz. Synthesizer 104 then divides this 221.9525 MHz frequency to equal 4 MHz. Any error between the reference and the divided VCO will produce a voltage which represents this error. This voltage is applied to varactor diode D1 of oscillator 106 to tune the VCO to the correct frequency. Capacitor C2 adjusts the center frequency of the VCO. Because the VCO must produce two frequencies, one for transmit at 221.9525 MHz and 243.3525 MHz, synthesizer 104 get reprogrammed between Transmit Mode and Receive modes to change the internal divisor to allow generation of either frequency from the same 8 MHz reference. The computers using a 3 wire serial interface, Clock, Data and Chip Select controls programming. Synthesizer 104 requires a short period of time for it to switch frequencies. During this time the LOCK signal is false. This LOCK signal is used to prevent transmission until the VCO has stabilized at the correct frequency. Buffer amplifier IC6 108 supplies the frequency to both the transmitter and receiver sections.

Transmitter DC power is controlled by transistor Q4, Q7, Q8 and Q9 (110). The components serve to inhibit application of DC power to the transmitter power amplifier 112 until we have Synthesizer LOCK and TX Mode is true. Power amplifier (112) IC-15 amplifies the RF signal from IC6 to the desired transmit level and feeds this signal to the PIN diode switching network 114 composed of PIN Diodes D5, D6. D7 and associated components. The PIN Diodes are forward biased in a manner to short the receiver input to ground and couple the transmitter output to the antenna matching network 116 made up of L14, L15, L26 and associated components. The matching network 116 acts as a low pass filter to remove out of band energy and to match impedance to the antenna 50.

The receiver is a dual conversion super heterodyne design using 21.4 MHz as its $1^{st}$ IF and 455 KHz as its second IF. Because of the extreme close channel spacing at the operating frequency, (5 KHz), the receiver is designed to provide very narrow reception. The bandwidth is less than 3.5 KHz. Several filters are used to produce this very narrow response, including a 221 MHz helical filter #1 (118), receiver RF amplifier 120, 221 MHz helical filter #2 (112). These components serve to reject out of band signals and provide a small gain in the signal. There are 4 poles of helical filter employed.

A $1^{st}$ mixer (221 to 21.4) (124), 21.4 MHz 4 pole crystal filter, $2^{nd}$ mixer and 21.9450 MHz oscillator perform the conversion from 221.9525 MHz to the 21.4 crystal IF filter center frequency. The mixer portion 124 of IC2 receives the 243.3525 MHz frequency from synthesizer 104 and mixes it with the 221.9525 MHz signal and produces 21.4 MHz, the difference. The 21.4 MHz is then passed through the 4 pole 21.4 crystal filter 126. This signal from the crystal filter is then fed into the second mixer stage in IC1 (128) where it is mixed with 20.9450 MHz to produce a difference signal of 455 KHz.

A 455. KHz $2^{nd}$ IF #1 (130), 455 KHz IF amplifier 132, 455 KHz $2^{nd}$ IF filter #2 (134) serve to limit the input signal by providing a very high level of amplification at 455 KHz frequency. This limiting removes AM components of the signal and it is then fed to the quad detector for conversion from FM to audio.

A quadrature detector 136, audio amplifier 138 and filter, carrier detector (140) recover the original FM modulated data from the 455 KHz if signal and filter it to remove the by products of the conversion and provide the audio to the modem on the main CPV board. A carrier detect signal is also provided by IC1. This signal is used to determine if a carrier at the 221.9525 MHz frequency is available.

Figure 5C:
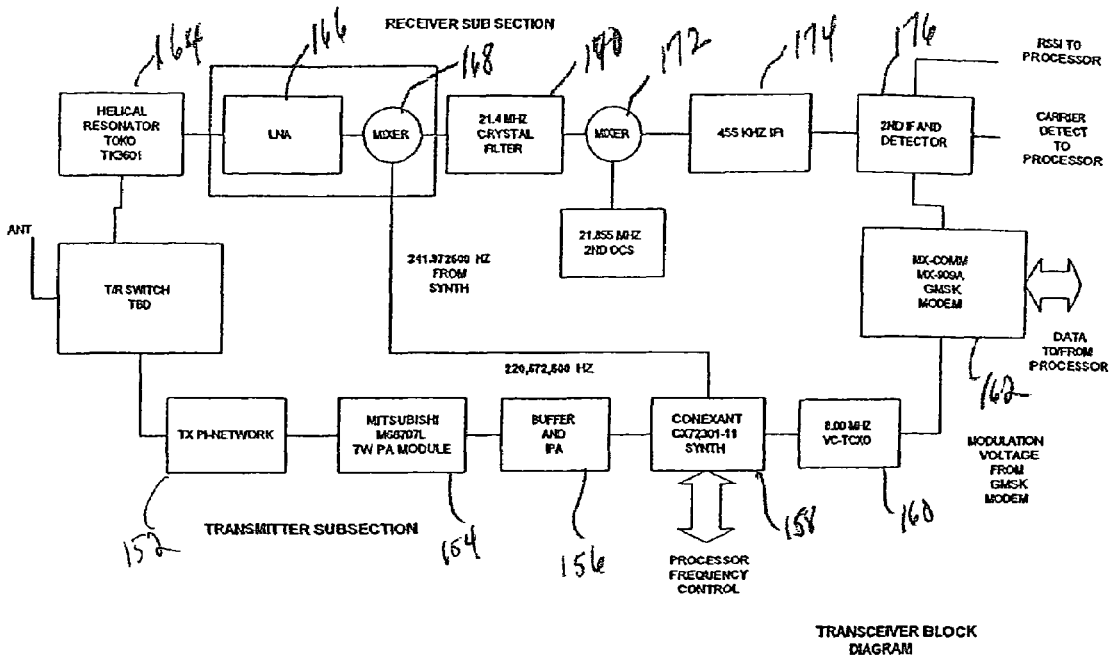
FIG. 5C illustrates a block diagram of another embodiment of the transceiver used in the warning system of the present invention.

With respect to FIG. 5C, a block diagram illustrates another embodiment of a transceiver 150 connected to a processor designed in accordance with a preferred embodiment of the communication protocol of an autonomous vehicle warning system of the present invention. In this example embodiment, the transmitter section includes a transmit PI network 152 connected to a power amplifier 154 and then to a buffer/IF amplifier 156. Buffer amplifier 156 is connected to a synthesizer 158 that is connected to a voltage controlled and temperature compensated oscillator 160 that is then connected to a modem 162. The receiver includes a resonator 164 connected to a linear amplifier 166 and to a mixer 168, with the mixer receiving a 220 MHz input from synthesizer 158. Mixer 168 is connected to a 21 MHz crystal filter 170 and to a mixer 172 that is connected to a 21 MHz oscillator. Mixer 172 is also connected to a 455 MHz IF filter 174 that is connected to a $2^{nd}$ IF filter and quad detector 176.

Figure 6A:
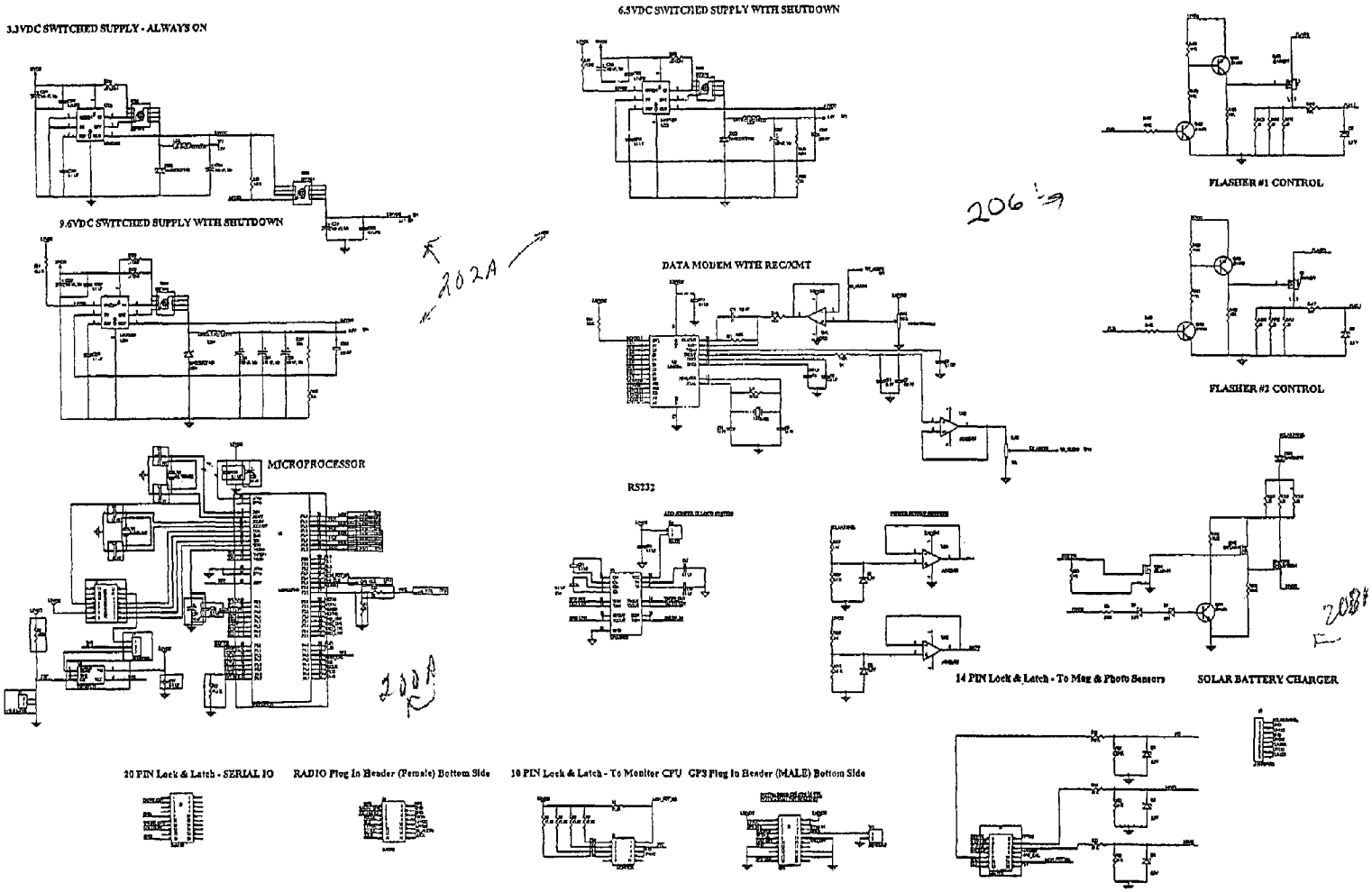
FIG. 6A illustrates a schematic of one of the processors for the warning system of the present invention.
Figure 6B:
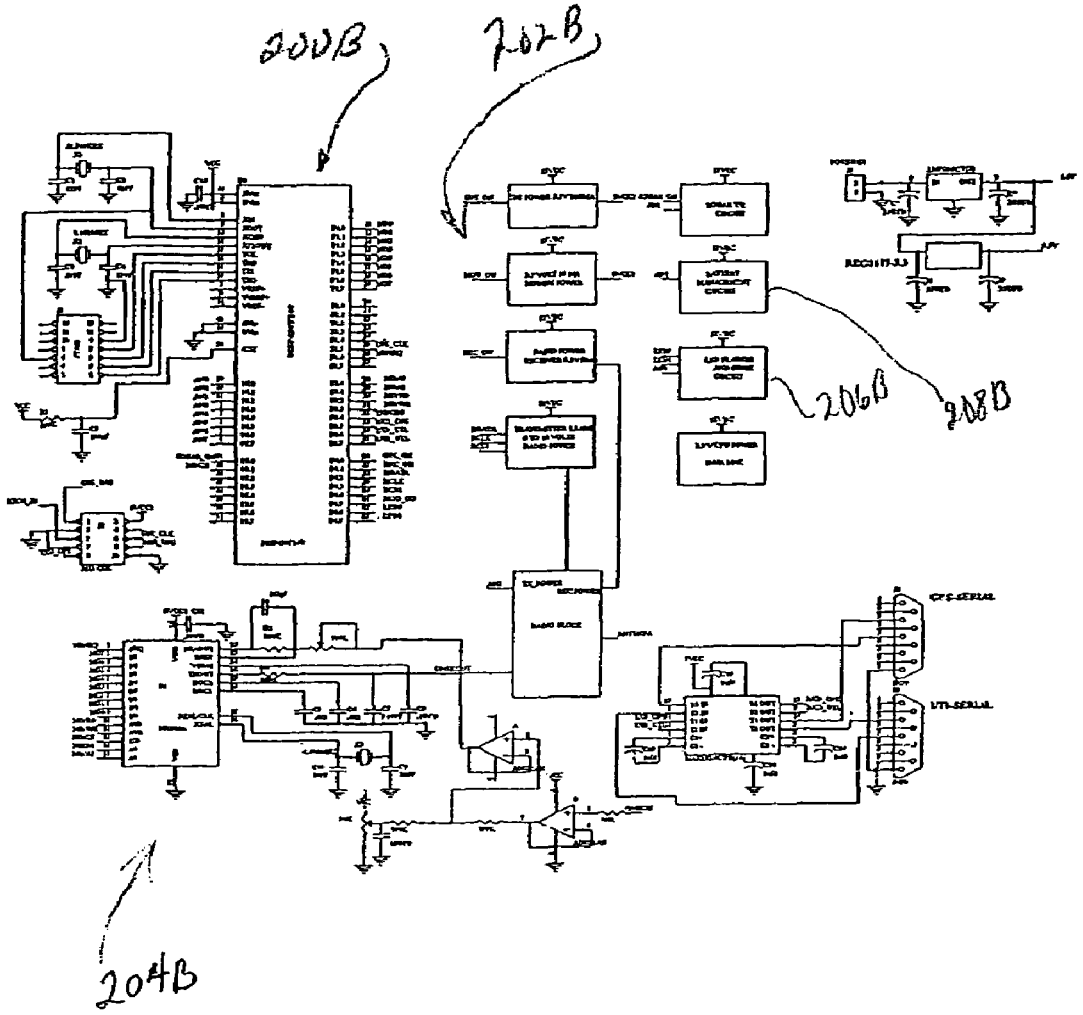
FIG. 6B illustrates a schematic of another embodiment of the processors for the warning system of the present invention.

FIGS. 6A-6B illustrate schematics of the processor and subsystems for warning system 10. In particular, FIGS. 6A and 6B illustrate processors 200A and 200B, respectively, that are the heart of warning system 10. Several switched supply circuits 202A and 202B are shown as well as a data modem 204A and 204B for receive and transmit capabilities. Flash controls 206A and 206B and solar battery charger circuits 208A and 208B are also illustrated.

Figure 7:
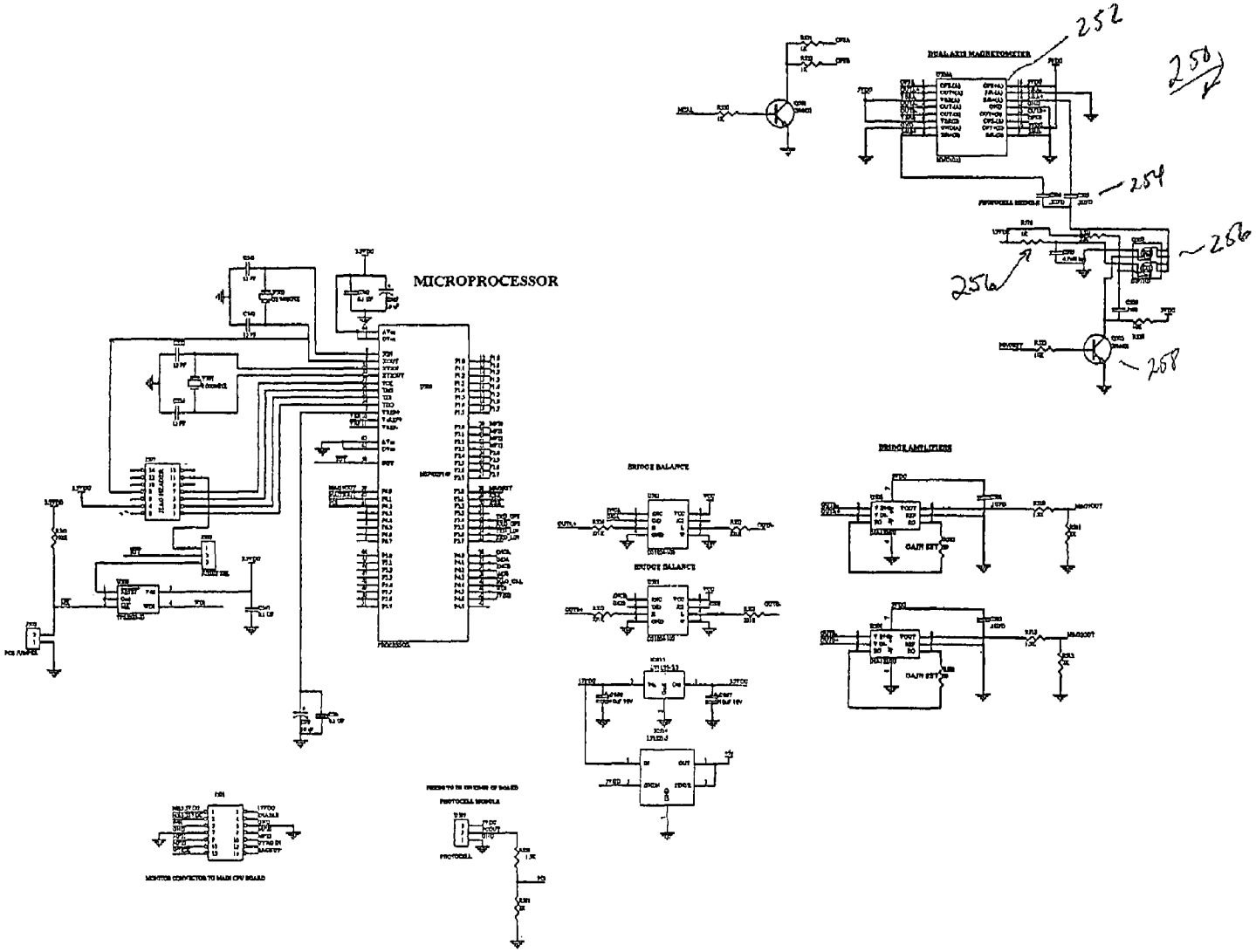
FIG. 7 illustrates a schematic of a magnetometer sensor detector used in the warning system of the present invention.

FIG. 7 illustrates a schematic of a magnetometer sensor detector 250 used as a substitute for the ultra-sonic sensors in warning system 10. The magnetometer sensor detects a train approaching or departing the crossing depending on changes in the magnetic field around the sensor caused by the size of the train. Magnetometer includes an IC device 252 connected to a photocell module 254 for power that is connected to a resistor 256 and transistors 256 and 258. Each magnetometer channel is read through an A/D converter that outputs a value between −4095 and 4096. Both channels are "zeroed" to mid-scale. The two channels are physically oriented so that when a train passes the crossing, one channel increases its signal and the other decreases its signal. Each magnetometer channel is read every $\frac{1}{8}^{th}$ of a second. After each reading of the magnetometer the difference between the channels is calculated and stored. The difference data is filtered by averaging the last 16 stored values.

Two separate XBARR calculations are performed on the last 64 (8 sub-groups of 8 readings each) filtered readings. Each of these calculations produces upper and lower control limits. One set of limits is used to determine the beginning of a train detection event (in limits). The other set is used to determine the end of a train detection event (out limits). These calculations are performed after each reading except when in a train event; the out limits already calculated are used until the end of the train event. Control limits only on the background data only. The new filtered data is tested to see if it is inside or outside the control limits. A train detection event is started when 90 percent of the last 8 filtered readings are outside the XBARR in limits. A train detection event is ended when 90 percent of the last 16 filtered readings are inside the XBARR out limits. The filtering and XBARR calculation require 80 readings to be buffered, so no detection is possible for the first 10 seconds. The 10 second delay is also used after train detection events end to be sure that no event data is used to calculate new control limits. The magnetometer is reset or re-balanced after each train event.

Power consumption is one of the challenges in implementing a warning system in remote locations utilizing solar power and batteries only. A locomotive or vehicle operating within the warning system does not have a power problem since both the vehicle and the locomotive are powered with generators. Therefore, a GPS receiver connected to the controllers can stay on at all times. However, the GPS receiver and the controllers located at the intersection need to transition into a "sleep state" in order to preserve power. The primary microprocessor in each controller goes to sleep and wakes up based on its 32 KHz clock. All of the devices in the warning system then wake up at exactly the same time to determine if a signal is being transmitted from an approaching locomotive. In this example embodiment, the goal is to minimize the size of the solar panel to keep the cost down. Therefore the devices wake up every two seconds and listen to see if signals are being actively transmitted. If no signal is detected within the first 10 milliseconds of waking up, the microprocessor determines that no signal is present and returns to its sleep state. It is important that all of the devices of the warning system wake up and sleep at exactly the same time to ensure synchronized communication with each other and with an approaching locomotive. However, the devices or controllers located at the railroad crossing experience drift in their crystal oscillators due to temperature and other factors and so there is a need to periodically resynchronize the clock within the microprocessors with a stable clock source. In this example embodiment, the GPS clock is used as the stable clock source.

In order to reduce power consumption, the GPS receivers at the crossings are also transitioned into a sleep state. However, at least once an hour the entire system wakes up and the GPS receiver requires the satellites, requires its positions, requires its timing synchronization from the satellites and then the software in the microprocessor acknowledges that it must divide its crystal oscillator frequency by 32,768. A one-second pulse should result indicating the one pulse per second in that frequency. If the crystal has drifted and it is putting out 32,772, for example, the frequency would be 4 hertz too high. Then the microprocessor determines that the crystal oscillator must be compensated in order to bring the crystal back to 32,768 hertz to ensure the controllers in the warning system are in synchronization with each other and with the approaching locomotive. In this example, the microprocessor uses the 32,772 as the divider to generate the one second clock that is used for comparing with the GPS retrieve time stamp. In the present invention the microprocessor compensates for the error in the crystal oscillator based on comparing it with the one second pulse that is generated by the GPS receiver.

Figure 8:
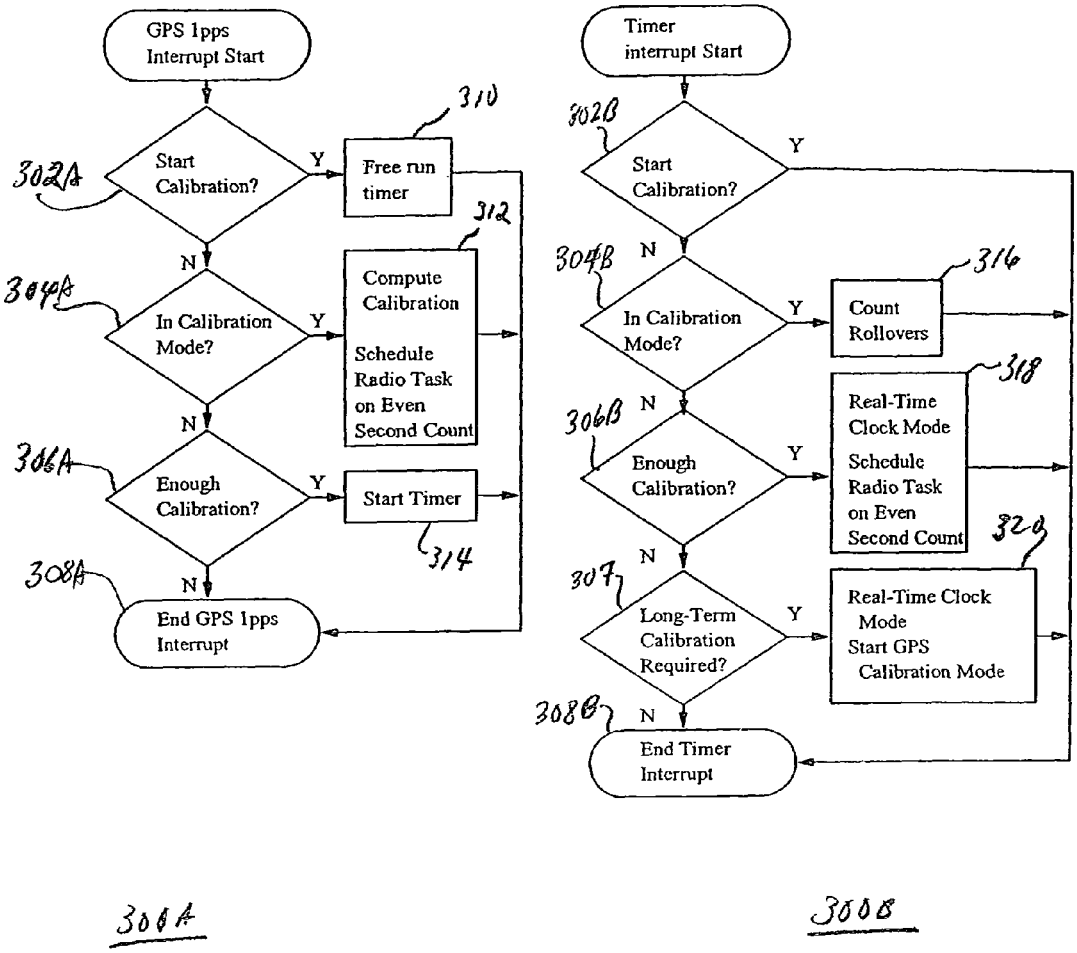
FIG. 8 illustrates a flow chart for the timing synchronization between the controllers of the warning system and a GPS system.

Referring to FIG. 8, a set of flowcharts 300A and 300B illustrate the process for calibration of the timers in the crossing controllers using the GPS clock. All critical tasks are dependent on precise timing synchronization with the GPS clock. When the GPS receiver is on, the GPS continuously sends out serial data to the microprocessor. When a complete GPS packet is received, a task is placed into the low-priority task queue to process the GPS packet (since the timing-critical portion of the GPS signal arrives via a different interrupt). The GPS packets are then split out into position, time, and other parameters. The GPS also emits a one pulse-per-second (PPS) interrupt. In normal operation, a GPS time packet indicating that this pulse is valid is generated about 400 ms before the actual 1 PPS interrupt. Running concurrently with this interrupt is a counter based on a 32.768 kHz crystal. The flow of events for each interrupt effectively synchronizes the counter with the GPS interrupt. Typically, the GPS runs for about 10 minutes on startup to synchronize with the counter, then runs for about 1 minute every hour after initial synchronization to maintain synchronization within the required tolerance for this system. To facilitate the hour synchronization, when the timer determines that an hour has gone by it issues a task to the task queue instructing the main loop to re-enable the GPS and resynchronize. In a related embodiment, the resynchronization can be implemented once every 15 minutes up to once every four hours.

Since the communications protocol for the system is predicated on precisely timed communications bursts, a timed-event queue has also been implemented. For example, every time the synchronized timer or 1 PPS GPS clock detect the occurrence of an even-numbered second, 6 timed events are scheduled, corresponding to each of the phases of the communications protocol: initial wake-up, locomotive arbitration, locomotive BEACON transmissions, crossing housekeeping, crossing acknowledgement, and token/map data communication. These events are scheduled to happen at 0 ms, 25 ms, 130 ms, 675 ms, 1000 ms, and 1500 ms, respectively. As each timed event expires, the task corresponding to each event is placed into the task queue by the event timer. The main loop receives these tasks (all high priority tasks due to their timing sensitive nature) and processes them as they are scheduled to happen.

A brief review of the synchronization process between the GPS and the timer and flowcharts 300A and 300B indicates that upon a GPS interrupt start at step 302A the system determines whether to start calibration or not. If not at step 304A, the system determines if it is in calibration mode. If the system is not in calibration mode at step 306A, the system determines whether there is enough calibration and finally in step 308A if there is not enough calibration then the GPS one pulse per second interrupt ends. With respect to flowchart 300B and the timer, the timer also follows a similar sequence of queries 302B through 306B but includes an additional step 307 of determining whether long term calibration is necessary. If such calibration is not necessary then the process proceeds to step 308B, the system determines to end timer interrupt. With respect to the timer process flowchart 300B, at various steps in the process the system may count rollovers in step 316 if it is in the calibration mode or schedule a radio task on an even second count at step 318 if there is enough calibration or start the GPS calibration mode at step 320 if long term calibration is required. With respect to flowchart 300A and the GPS receiver, calibration can start at step 310 with the prerun timer which will then end the GPS interrupt. With respect to step 312 if the system is in calibration mode, the calibration will be computed and a radio task on an even second count will be scheduled. With respect to step 314, if there is enough calibration, the timer starts and then proceeds eventually to end the GPS interrupt.

One of the advantages of the present invention is that a network controller with a central database is not necessary to keep track of the addresses of the various controllers in the warning system. The controllers at the crossings do not necessarily require assigned addresses upon initial installation. The present invention utilizes the geo position, the latitude/longitude coordinates provided by the GPS as an address. After a crossing controller is installed on a cross buck with a GPS receiver, the controller will wake up, retrieve its location using the GPS receiver and its latitude and longitude coordinates, and from that point on the controller uses as its address the geoposition. This will also be the controller's address in the locomotive database. As the locomotive is moving through the system, it can say I'm at Waseca, Minn. (latitude X/longitude Y) and what are the 8 closest ones divided by my latitude and longitude in the database. And then it can compare that with the 8 at the crossing knows about what it is encountering, if they are different, they can fix each other. Therefore, the latitude and longitude generated by the GPS receiver at the crossings also serves a purpose other than for timing synchronization.

In a related embodiment, the locomotive can be advised of its correct location in the event there is a problem with the GPS system in a particular location using differential GPS. The controllers can provide the corrections to the GPS reception of the locomotive. This approach provides a benefit to railroad companies that are interested in implementing positive train control, such as in attempting to determine remotely whether a train is on the main track or the side track when the tracks are only 13 feet apart.

Figure 9A:
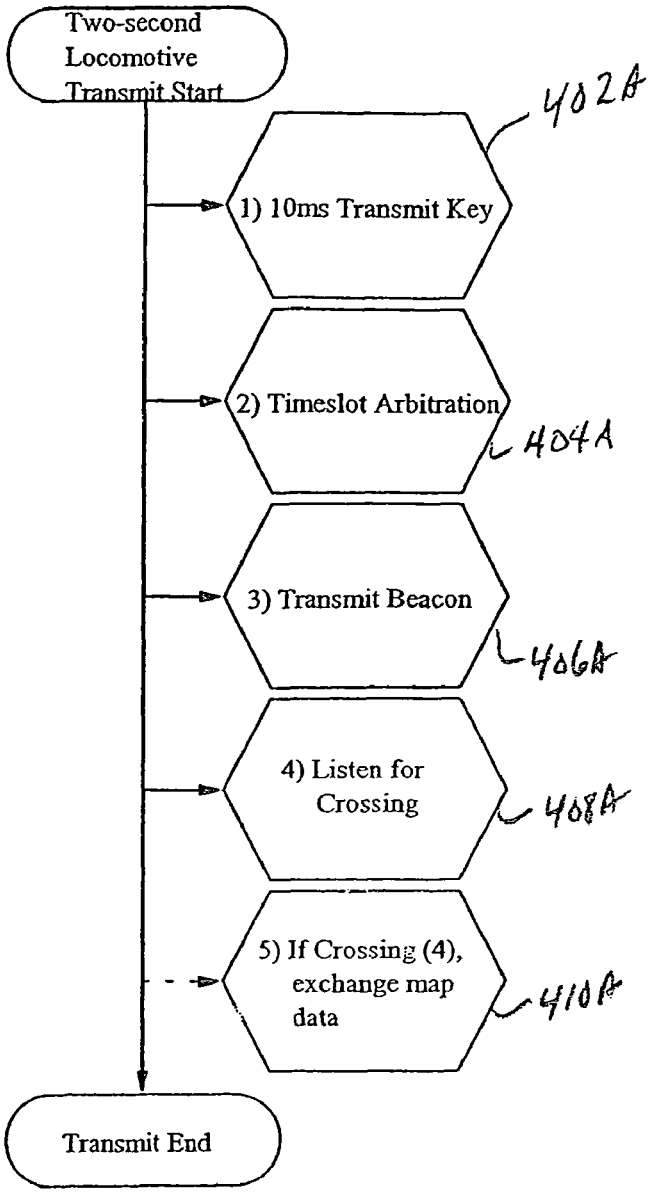
FIG. 9A illustrates a locomotive communication sequence according to the present invention.
Figure 9B:
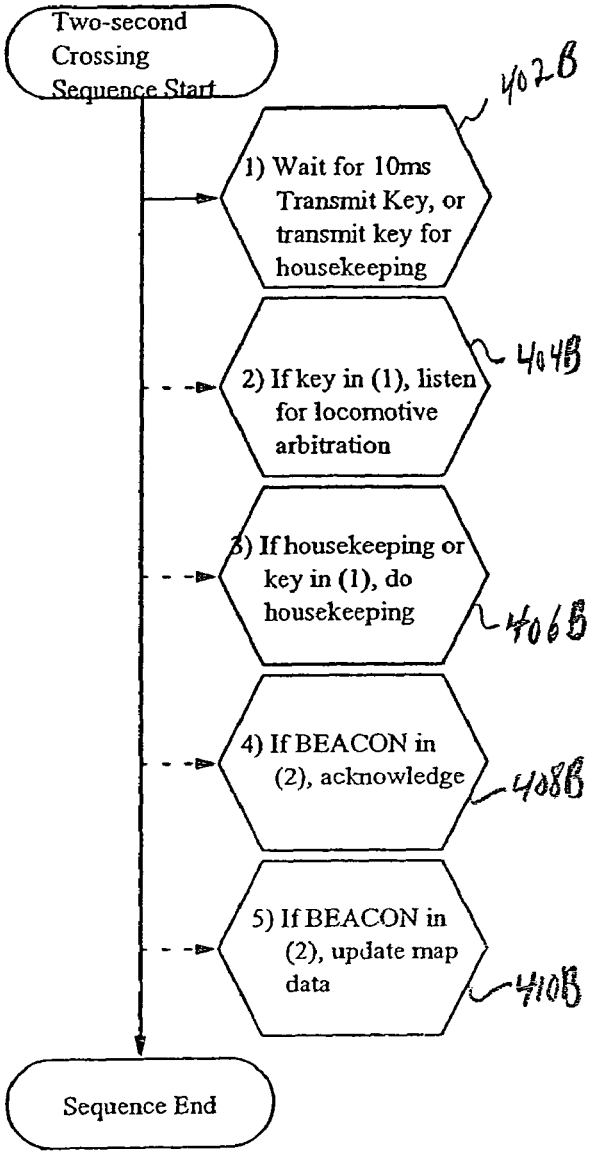
FIG. 9B illustrates an example of a railroad crossing communication sequence according to the present invention.

Referring to FIGS. 9A and 9B, two flowcharts 400A and 400B, respectively, illustrate two-second communications sequences for a locomotive and a crossing. In both flowcharts, communications protocol tasks are loaded into the timer event queue when an even-second task is processed since communications tasks are high priority. The task queue is actually made up of two queues: one queue is for high priority tasks, such as radio communication, and the second queue is for low priority software maintenance tasks (such as reading the temperature, maintaining the real-time clock, etc.) Tasks are always fetched and executed from the high priority queue first. After all the high priority tasks are executed, low priority tasks are given a chance to execute. Due to the timing critical nature of the high priority tasks, the low priority tasks are time-limited to less than 100 μs execution time. Regardless of the priority the task, all tasks are internally guarded by an event timer to not exceed a specific time allocation.

FIG. 9A is an example of a locomotive 2-second communications sequence 400A that includes five steps that are queued up as timer events. As the timer expires each event in order, a task is pushed onto the task queue. The main loop reads each consecutive task out of the task queue and processes it in turn. With respect to step 402A, the locomotive transmits a 10 millisecond transmit key which is then followed by a time slot arbitration at step 404A. Once the time slot arbitration time has expired, the train transmits the beacon signal at step 406A and then at step 408A the train listens for an acknowledgement or a signal from the crossing. At step 410 the controller on the train determines if there is a need to exchange map data with the crossing based on the feedback from the crossing at step 408A. If so, the exchange data is performed and the transmission ends.

FIG. 9B is an example of a crossing 2-second communications sequence 400B that corresponds to the steps of process 400A. As with the two second transmit sequence on the locomotive, these five tasks are all scheduled as timer events initially. As the timer reaches the scheduled time for each event, the corresponding task is pushed onto the task queue where the main task is pushed onto the task queue where the main task handling loop performs the appropriate actions. Corresponding to the communications from the locomotive and flowchart 400A, at flowchart 400B the crossing at step 402B waits for the millisecond transmit key or performed housekeeping processes until it is timed out. At step 404B, if a transmit key is received from a locomotive, then the crossing controllers listen for a locomotive arbitration until the step times out. At step 406B, the crossing controllers conduct housekeeping if housekeeping is in order or if there is a transmit key to the locomotive. At step 408B, the crossing controllers perform an acknowledge function if a beacon signal is detected from the locomotive. At step 410B, the crossing controllers will perform an update of map data in response to the beacon data from the locomotive after which the sequence for the crossing ends.

Figure 10:
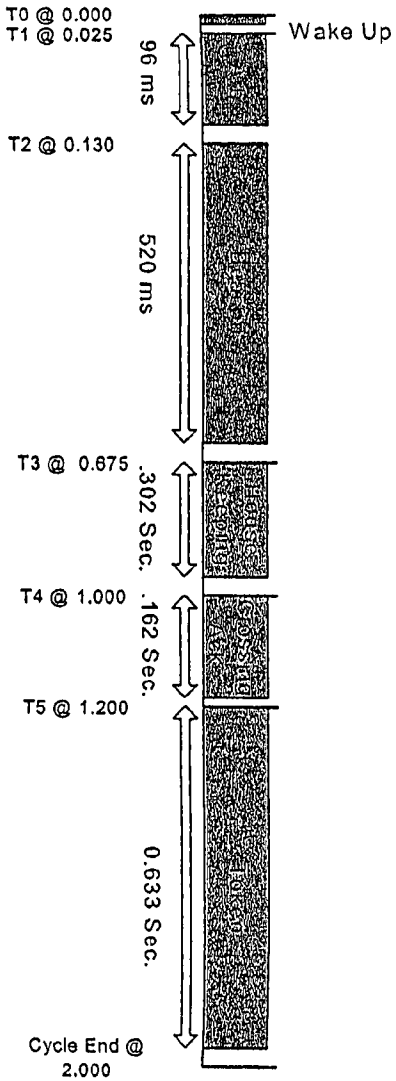
FIG. 10 illustrates a sequence of communications windows that occur within a two-second window as part of the warning system of the present invention.

FIG. 10 illustrates a sequence of communications windows that occur within a 2 second window as part of warning system 10 of the present invention. All controllers are synchronized to the GPS clock but do not necessarily require a 1 ms of accuracy. A guard band is inserted around every timing window. If each unit may drift a maximum of 1 ms then a 2 ms guard, or 1 ms on both sides, is used. For each transmit, it could occur 1 ms early or 1 ms late from the nominal expected window. A 10 ms total window must have a maximum receive window of 10 ms+1 ms+1 ms=12 ms plus a dead band between transmits. From one transmit to the next we will have a dead band of 1 ms. This amount of time will let the processor receive and decode the last communication. This will also let our processor act as a state machine of 1000, 1 ms timed functions.

A short window at time T0 is used as a "wake up". Any device that will transmit any data must use this window first to tell the—"wake up and listen". If it hears this window it knows to listen more. If a master controller at a stationary warning crossing wants to talk to its slaves it must use this window to tell the slave controllers to wake up and listen. Every locomotive broadcasts in this window prior to sending the beacon. Typically the intersection controllers will only listen to this and can sleep the other part of their days. T0 lasts for 1 ms+10 ms+1 ms+1 ms dead band for 13 ms, which gives T1 at 13 ms or beyond. As an example, choosing 25 ms gives flexibility in the wakeup. In 10 ms may not be possible to send out the header, which takes 12 ms. This wakeup is just a carrier detect and lock.

FIGS. 11A-11D are a series of time slot diagrams illustrating locomotive radio communications when multiple locomotives are communicating simultaneously with warning system 10. In this example embodiment, within a 25 ms window the communications protocol allows 8 locomotives in any communication grid (see FIG. 11A). This scheme uses the beginning interval of the BEACON transmission from the locomotive to encode the active channels that are being used. This encoding is the network protocol, which allows the locomotives to chose the correct channel for data transmit. The first half of this time slot performs the locomotive arbitration while the second half is the actual beacon transmit. Adding a locomotive will cost 12 ms+67 ms for 79 ms in total of time. The arbitration preferably is performed with a 2 ms carrier detect.

Figure 11A:
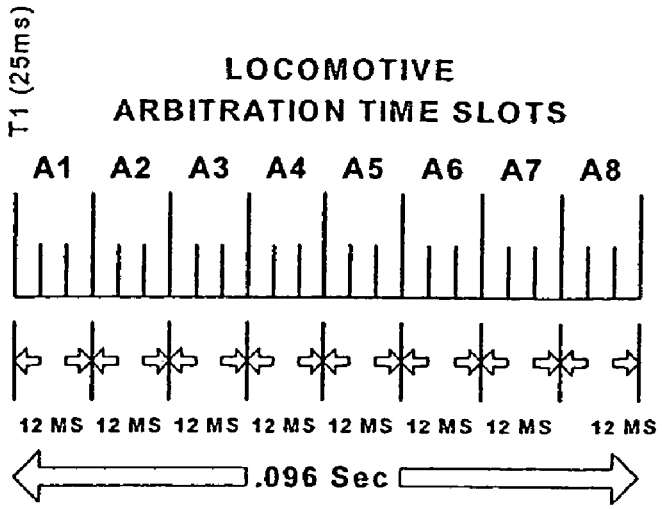
FIG. 11A illustrates the arbitration time slots for up to eight locomotives.
Figure 11B:
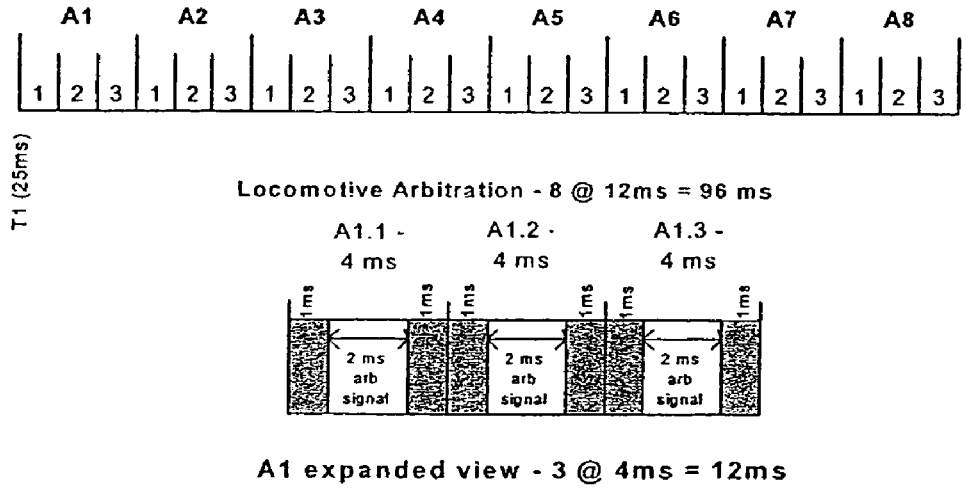
FIG. 11B illustrates an expanded view for each of the locomotive arbitration time slots.

In FIG. 11B, A1-A8 are divided in to 3, 4 ms windows each for 24 sub windows. The total Arbitration is 0.096 seconds. By way of example, for a maximum of eight locomotives, if locomotive #1 is in time slot A1 then it will randomly transmit its arbitration beacon in 1 of the 3 sub slots of A1 while listening to all other 23 slots. Using this procedure the locomotive will ask: A) whether another locomotive in the same slot, and B) what time slots are being used. If locomotive A and locomotive B are in Beacon slot 1 they randomly transmit their arbitration in one of the 3 arbitration sub slots, A1.1-A1.3. If locomotives hear other locomotives in their arbitration window they know two or more locomotives are in the same beacon interval, which should be avoided. The locomotives next determine who was $1^{st}$, $2^{nd}$ and so on. The first sub-slot will stay in the first beacon time window. The second will take the second beacon channel and the third the next.

Figure 11C:
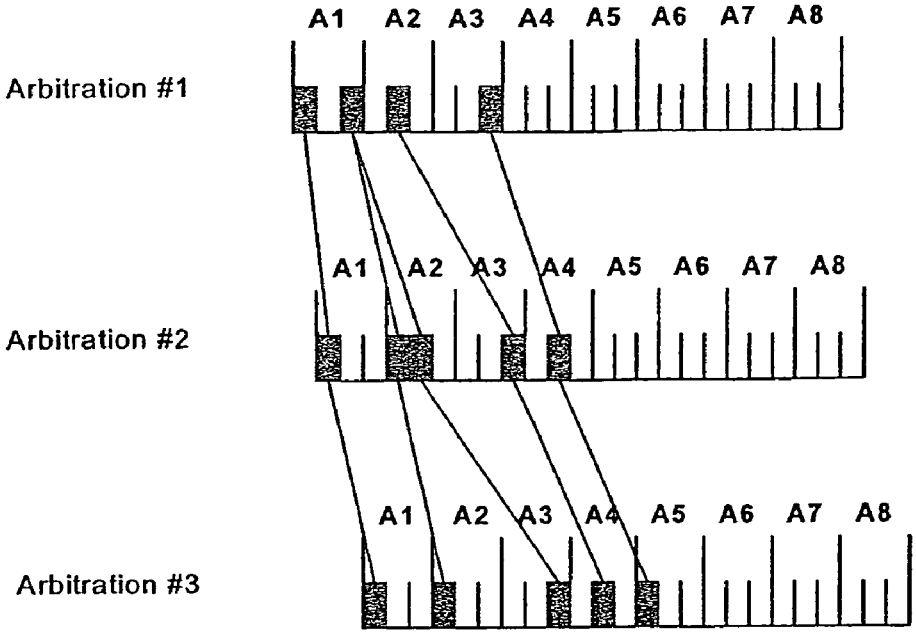
FIG. 11C illustrates the arbitration scheme for four known locomotives.

FIG. 11C illustrates the arbitration sequence for 4 known locomotives; two or more are in A1, one is in A2 and at least 1 is in time slot A3. The arbitration sequence is as follows:

Arbitration 1: The first locomotive was A1.1. This locomotive will stay in slot since he was the first device to use an arbitration slot. The locomotive in time slot A1.3 will move to A2 since he was the second device to arbitrate a position. This proceeds through all 8 locomotives. Each Beacon window following arbitration will reflect the choices shown in Arbitration 2.

Arbitration 2: After arbitration #1 the locomotives use the assigned beacon position. They will then re-arbitrate at random positions 1-3 of their time slot in arbitration #2 as shown above. The locomotive in time slot #1 believes he is the only one in one and the first in a string of arbitrations so he will stay there. The locomotive in A2.1 discovers he is the first in A2 and will stay there as well. The locomotive in A2.3 discovers he was the third and thus should be in beacon slot A3 and will move to this slot. The locomotive in slot A3.3 discovers he was the fourth and thus should be in A4 and will move over to this slot. This proceeds down through all slots and locomotives. After arbitration #2 the locomotives use the assigned beacon position.

Arbitration 3: Each Locomotive will re-arbitrate at random positions 1-3 of their time slot in. This set of locomotives will all use the beacon channel they are in and will randomly select sub slots 1-3 of their arbitration window for each subsequent arbitration.

If a wake up is received, the crossing knows to listen for arbitration. The master controller at the crossing will now know many trains are dialoging and in what beacon slots to listen. If no arbitration occurs but A0 was used the controller knows a master controller is going to transmit or an acknowledge will occur. The GPS latitude and longitude is used as the seed for the random number generator.

Figure 11D:
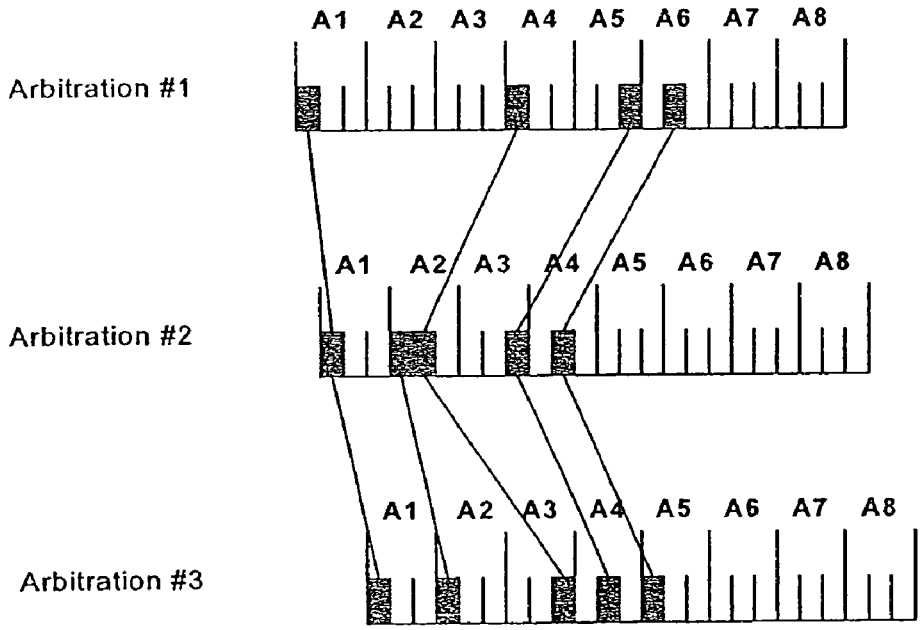
FIG. 11D illustrates an arbitration scheme to address the situation of a locomotive that drops out of communications range.

FIG. 11D illustrates an arbitration sequence to address the situation of locomotives that drop out of communication range. In this example, for some reason, two trains drop out of communication range. These two are either permanently out or range or will fade back in soon. Either way, the algorithm is the same. The first arbitration slot goes to A1, the second to A2 and so on. We see that in Arbitration #2 the locomotive which was there fades back in. This will force all locomotives after this one to move down one and let the new one in. It should be noted that in this fad in and out case of 1 locomotive we will not lose many communication since they see the problem and immediately adjust their beacon and re-arbitrate every cycle. Finally—the crossing always knows what slot to listen in and only needs a wake up for the A0 wake up call every time. By default any locomotive all by itself will be in slot A1 and beacon #1.

Figure 12:
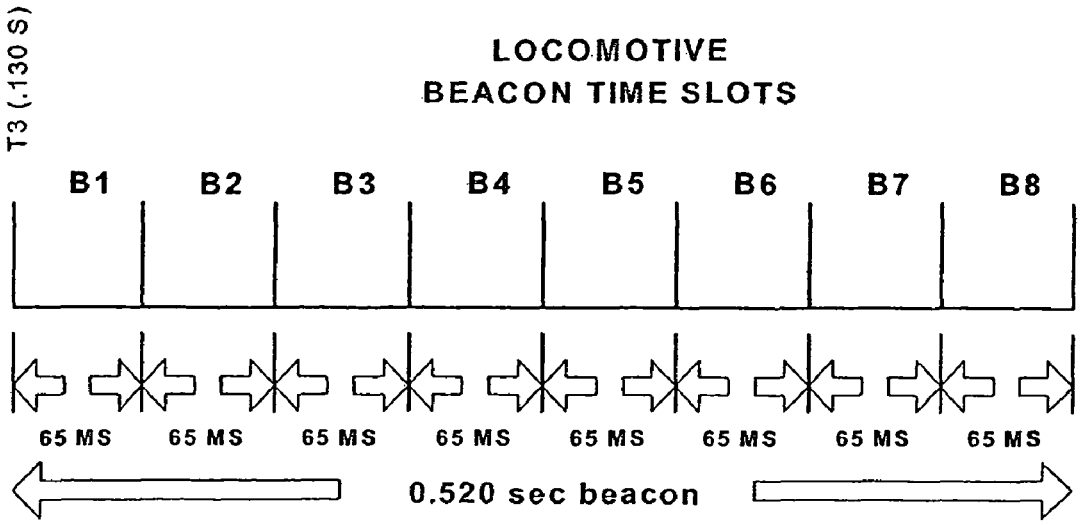
FIG. 12 illustrates a locomotive begin transmission with its respective time slots operating within the warning system of the present invention.

FIG. 12 illustrates a locomotive beacon transmission during operation of warning system 10. The beacon signal occurs after the arbitration and the Locomotive time slot takes into consideration the arbitration results. Every locomotive will transmit a header followed by a data block containing the position, heading and speed of the locomotive.

FIGS. 13A-13H illustrate the basic framework for intercrossing communications according to the present invention. All housekeeping is performed at low power (about 100 mw or less), which drastically limas the range f communication and cross talk. In the real world of vehicle warning systems, there is no real control of the installations, the number of devices per crossing or distance between crossings. Thus, there must be another arbitration protocol to clean up the communication and optimization after installation. The concept is for every crossing in range of each other to have a specific time slot. A maximum number of crossing devices per area is first selected. In the preferred protocol, there is a limit of 16 devices in any 300-meter range (see FIG. 13A). Clusters can overlap and will have unique ID's. The housekeeping is used for status, light on, lights off and so on. It should be noted that the locomotives have a special 0.6 seconds for arbitration, whereas the crossing controllers have no special arbitration time and therefore is provided for in the command structure.

Figure 13A:
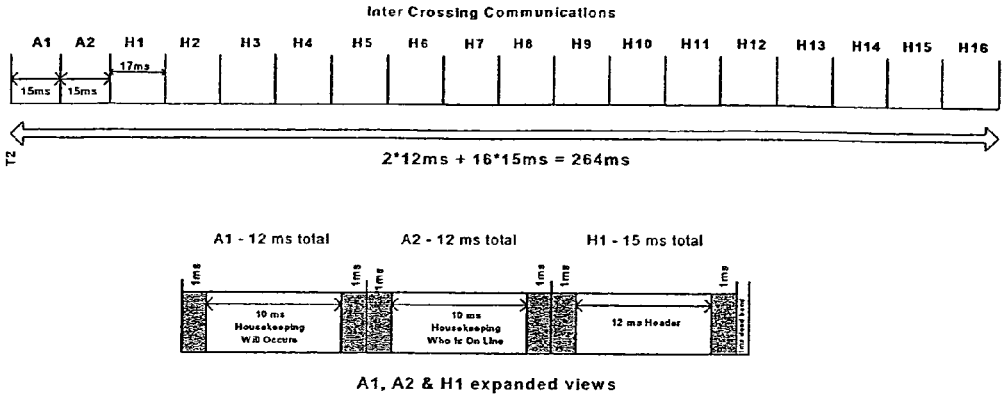
FIG. 13A illustrates the basic framework for inter-crossing communications according to the present invention.
Figure 13B:
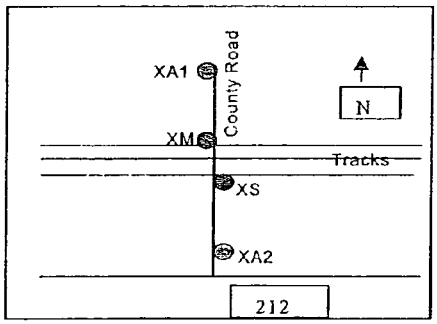
FIG. 13B illustrates an installation of the warning system according to the present invention.

In one example for installation of warning system 10, the controllers in FIG. 13B are initially identified as the Master (XM), Slave (XS) and the two advanced warning controllers (XA). The time slot selection will follow this predefined structure and helps to simplify the intercrossing communication protocol. During installation of system 10 on a set of East-West running tracks, the Master controller is located on the North side of the tracks with the Slave being located on the South side. During installation of system 10 on a set of North-South running tracks, the Master will always be on the West side and the SLAVE will always be on the East side. For example, the first advanced controller from the Master on the north/west side will be programmed to XA1, second XA2 and so on. The first unit on the south/east side would be the next sequential number, XA3 in this example. The sequential members continue increasing as additional XA's are added.

Figure 13C:
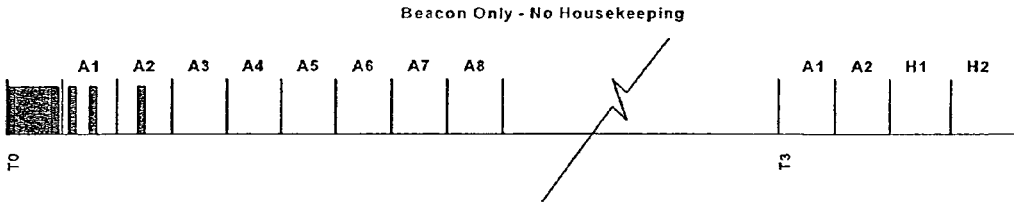
FIG. 13C illustrates the system waking up upon detecting a beacon transmission from a locomotive.
Figure 13D:
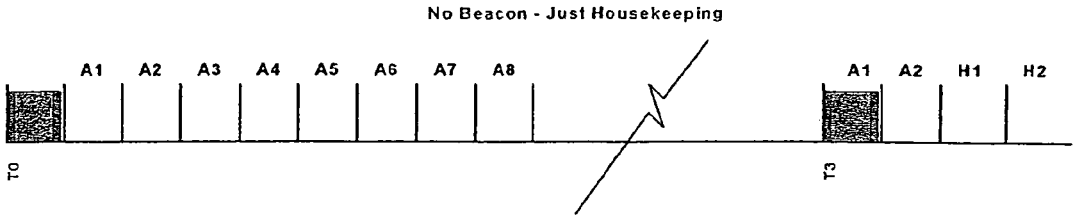
FIG. 13D illustrates the warning system waking up irrespective of a locomotive or housekeeping.
Figure 13E:
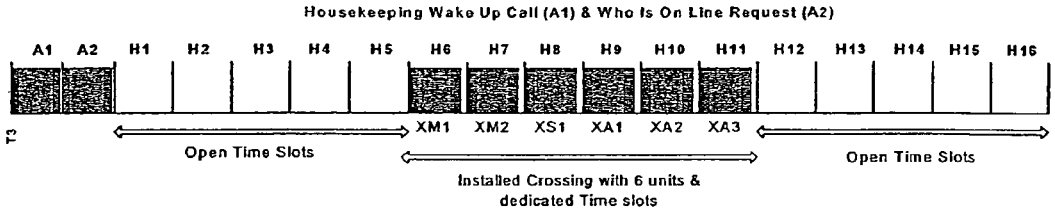
FIG. 13E illustrates the status of other controllers on the crossing as the master controller is being powered up for the first time.
Figure 13F:
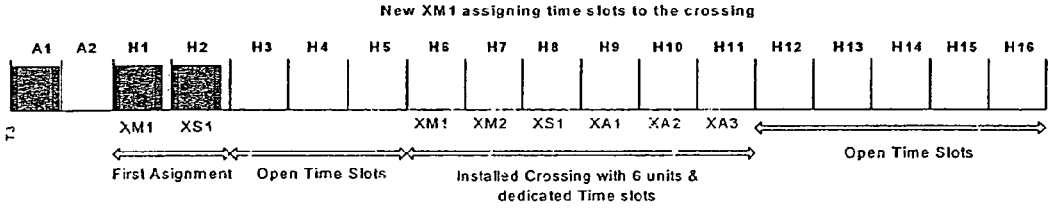
FIG. 13F illustrates how the master controller assigns time slots to itself and to the slave controller.
Figure 13G:
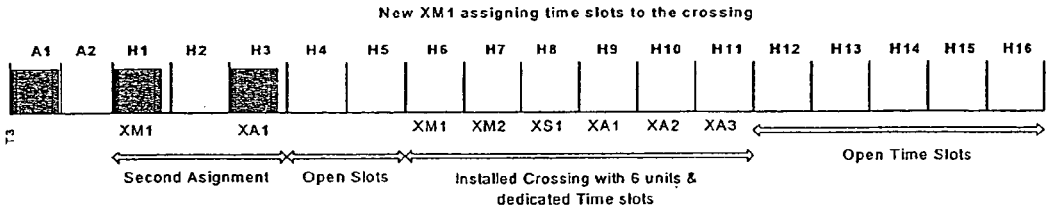
FIG. 13G illustrates the master controller assigning a time slot to one of the advanced warning controllers.
Figure 13H:
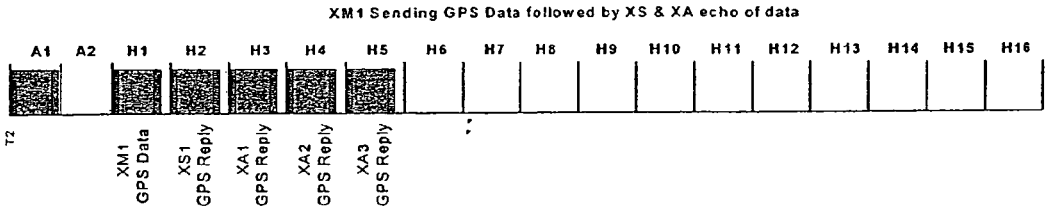
FIG. 13H illustrates the master controller sending GPS data to all of the units within its control.

In FIGS. 13C and 13D, the details of the preferred embodiment of a Housekeeping Command Protocol is illustrated and described. Where there is no T0 wakeup, no housekeeping is performed. To conserve power, all units turn on at T0 to see if anything is going on. In the following case nothing is going on so after 12 ms all units go back to sleep for the remainder of the 2 second communication cycle. This gives a 0.6% wakeup duty when nothing is happening. When there is a wakeup at T0 and no housekeeping, at T0 all units wake up and listen. In the following example we see a T0 wakeup. At this time we do not know if it is a locomotive, housekeeping or both. All units must listen to the beacon arbitration. The controller sees 3 of the 24 slots utilized and so it must listen to Beacon 1, 2 and 3 because there are 3 locomotives. At T3, the controller issues a wakeup and listens to see if any crossing communications are required. Because it sees no A1 wakeup, the controllers can sleep again.

At T0 wakeup with housekeeping, preferably all units wake up and listen. In the following example we see a T0 wakeup. At this time, it is unknown if it is a locomotive, housekeeping or both. All units must listen to the beacon arbitration. If there are no arbitrations, the controller sleeps through the beacon timeframe. At T3, the controller performs a wakeup and listens to see if any crossing communications are required. Because A1 is used but A2 is not, the controller listens to the masters only. In the above example, it is possible to have had a beacon since it makes no difference to the A1 wakeup. If a master wants to talk it must occur at wakeup at T0 and T3.

Time Slot Selection Details of Crossings is described in connection with FIGS. 13E-13H. On first power up, the crossing master will transmit a status request in the second arbitration slot. This is done at the 100-mw-power level to see all local crossings in radio range with a programmed time slot. Every crossing with a time slot answers with status in its time slot. The new warnings will not answer since they do not have time slot. This teaches the Master what is occurring in his low power environment.

The MASTER1 knows which are the open time slots (H1-H5 & H12-H16). The MASTER1 was preprogrammed with this size and configuration (such as 4 MASTER1/SLAVE1/XA1/XA2). The MASTER1 will now pick the first open slot and program its slaves 1 by 1 verifying proper time slot progression. In this example, the MASTER1 will program and receive positive confirmation of SLAVE1. The MASTER1 will specify it is talking to any un-programmed SLAVE1 and will tell the SLAVE1 what its set time slot will be. The SLAVE1 immediately takes the time slot and responds to the MASTER1 with the echo of its program command in it programmed slot. The SLAVE1 will now only answer the MASTER1 in time slot H1. The SLAVE1 knows who programmed it and who it should listen to from this point forward.

After the new MASTER1 is able to communicate with the SLAVE1 it will communicate with the XA1 (next on its control list). This process will follow the same protocol. To save power during installation the MASTER1 should be the last device to be powered up allowing quick setup and less transmits of setup. Every device must know what it is and every Master must know the total configuration. This will proceed until the MASTER1 detects that all is well and all units are programmed. The MASTER can verify final installation by requesting a status and hearing back from its own units. Only its units will answer since all XA's and SLAVE's; only listen to the master whom programmed them and answer this master.

With respect to GPS coordinate programming, the MASTER1 must program all units in its warning system with the proper installed GPS coordinates. This GPS data is only programmed on the first power up configuration and is only used for Master failure backup. To do this, 8 transmits are used with a command telling the SLAVE & XA's what is coming. The MASTER1 will then send a command telling all future devices at this crossing what the command and byte are, for instance, longitude 4, Byte 4 of longitude. Every device in the network will echo back the command they just received so the Master knows if things are fine. After any unit receives its geo-position it will immediately respond with an acknowledge command so the MASTER1 can verify all units were programmed correctly. If the MASTER1 does not get a proper response from one of the units it will know there was a problem and will resend the GPS byte in error.

Figure 14A:
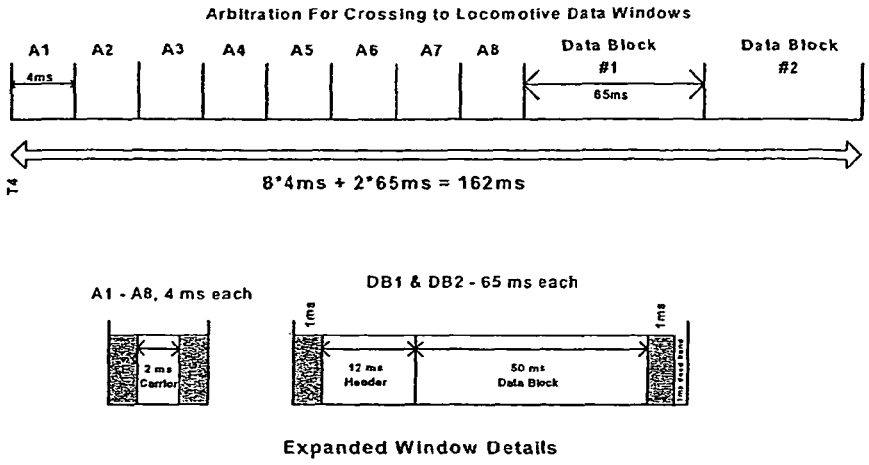
FIG. 14A illustrates the basic scheme for locomotive acknowledgement within the warning system of the present invention.
Figure 14B:
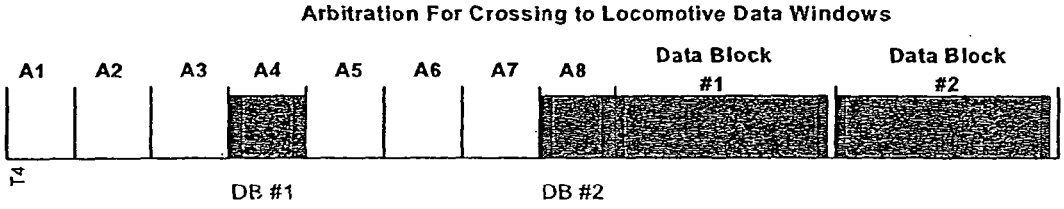
FIG. 14B illustrates an arbitration for a railroad crossing from the master controller to the locomotive.
Figure 14C:
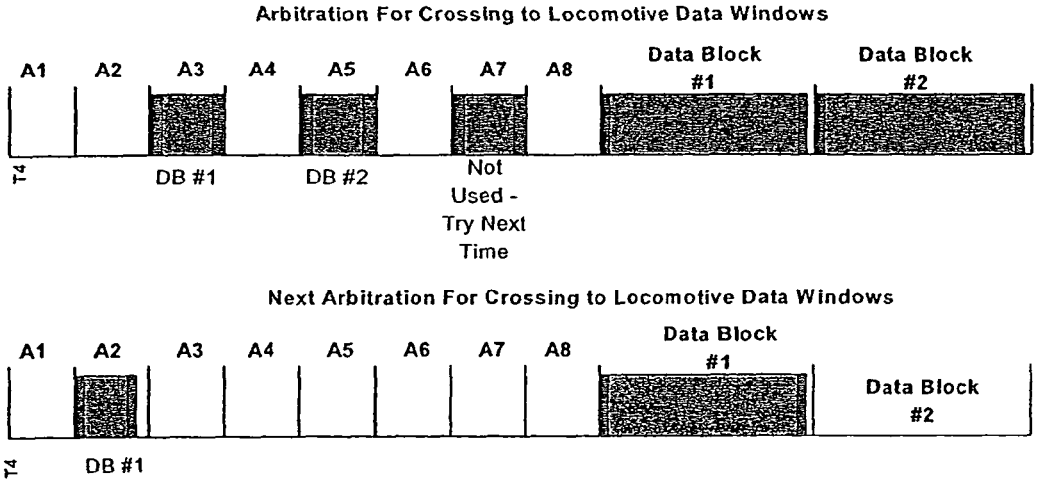
FIG. 14C illustrates an arbitration for crossing where there are three requests for acknowledgement made to a locomotive.
Figure 14D:
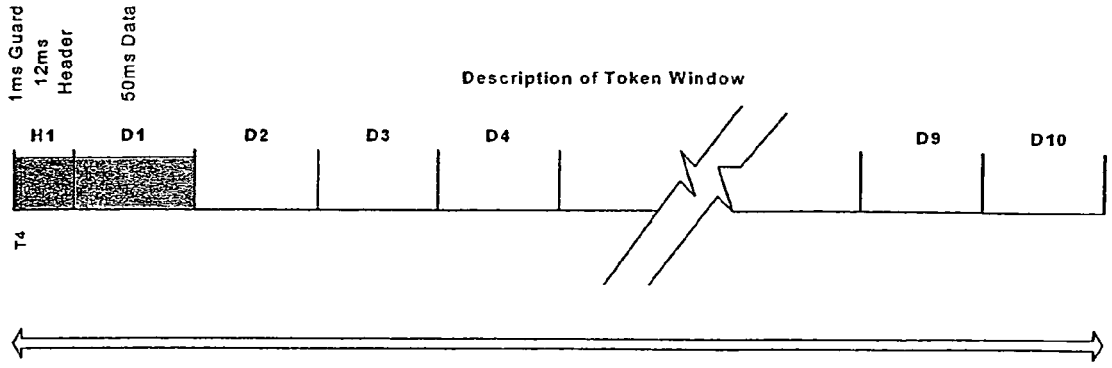
FIG. 14D illustrates a token communication window for sending large blocks of data.

FIGS. 14A-14C illustrate the locomotive acknowledgement process and the token communications window (FIG. 14D) warning system 10. This basic T4 communication window is for sending the locomotive controller status. This is done at high power and needs to be flexible for many crossings in a 2-mile radius. To make he present invention simple and flexible, it is preferable to arbitrate randomly on 8 windows and the first 2 requests will get the Acknowledge windows.

When a response is made, it is preferable to transmit the position since the crossing just replies to all locomotives in general and the locomotive decides what to do with this information. Preferably, this communication is done from the crossing to the locomotive after the housekeeping in order to quickly and efficiently answer status in the same timing window. The only time the controller wakes up and listens to this window is if the controller you want to uses it. If the controller is not talking to a locomotive, the controller just sleeps during this section. Seeding the random number generator occurs when first turning on the crossing from a locomotive activation or projected activation.

At T4 a locomotive acknowledges is received from the master controller MX, where there are two crossing master controllers. Each of these MASTERs wants to transmit some information to a Locomotive. These two MASTER's will randomly select a position A1 through A8 based on the seed of the locomotive arrival at the crossing. These two crossings were the only ones requesting to communicate so they both get to talk in the acknowledgement windows. In this example there are three requests for the acknowledge window from MASTER to a Locomotive. The system is only able to do two of these and the third must wait until the next window.

With respect to the basic T5 Token communication window, preferably this is used for sending large block of data quickly. This is accomplished by using one guard band and header followed by 10 streamlined data blocks. A typical 8 crossing data map would be 4 long., 4 lat, by 8 for 64 bytes+40 unknown for 100 maximum.

Additional examples of locomotive beacon signaling:

EXAMPLE 1

A locomotive is just passing time and heading down the track—nothing is around and it is in beacon slot 1. At time T0 it will use the wake up followed by Arbitration slot A1. It will next randomly pick a sub slot of A1.*a*-A1.*c* and listen to all 27 remaining arbitration slots. It will discover that it is the only locomotive around and thus stay in beacon slot #1. In the Beacon #1 Header the locomotive will transmit command 0x00 and its ID. This is a Beacon only transmission. This would leave the token open for the next locomotive or intersection to use. The token is grabbed by whoever takes it first. In the Beacon #1 Data block it will transmit position, heading and speed. The locomotive is always listening when it is not transmitting so it will just listen until it either arbitrates with another train or it is replied to from an intersection.

EXAMPLE 2

A single locomotive has approached a single intersection and now receives an acknowledgement. This assumes the Master is functional. All the same as above—just a simple beacon. The intersection has been programmed and arbitrated. The system is fully set up for position, housekeeping and acknowledge. We look at the Beacon and see if it is time to respond or not. If not we sit and watch the locomotive approach and verify proper vectors and so on. When the Locomotive is 45±1 seconds it is time to act as follows. In time slot T3 the MASTER will transmit control command 0x02—Turn On—with 10-13 seconds countdown to the controllers in the same time slot. In the SLAVE and advanced warning slots for this crossing we receive back 10x01—Status Reply xxxxxxxx. The MASTER looks at the replies to verify everyone is working and received the turn on command. If the MASTER sees an error it can retransmit the turn on command a second time and watch the replies. This can be done 3 times to ensure that there is more than one chance to do a correct transmit from the Master to all intersections. By 35 seconds from arrival an acknowledgement to the locomotive. A reply in the acknowledge slot T4 is arbitrated in this slot. A return to the Status in the control block of the header and Position in the data block and the Locomotive will display its status accordingly. If a unit has failed, do not try to turn it on again after an acknowledge to the locomotive.

EXAMPLE 3

A single locomotive has approached a single intersection and now receives and acknowledge. This assumes the Master functions but the SLAVE or advanced controller failed. The intersection has been programmed and arbitrated and is fully set up for position, housekeeping and acknowledge. A look at the beacon determines if it is time to respond or not. If not we wait and watch the locomotive approach and verify proper vectors and so on. When the Locomotive is 45±1 seconds it is time to act as follows. In time slot T3 the MASTER will transmit control command 0x02—Turn On—with 10-13 seconds countdown to the controllers in the same time slot. In the SLAVE and advanced controller slots for this crossing we receive back 0x01—Status Reply xxxxxxxx. The MASTER looks at the replies to verify everyone is working and received the turn on command. The MASTER will immediately know there is and error and a unit is nonfunctional. The MASTER can retransmit the turn on command a second time and watch the replies. This can be done three times to ensure that there is more than one chance to do a correct transmit from the Master to all intersections. By 35 seconds from arrival the locomotive must be acknowledged and a reply in the acknowledge slot T4 as arbitrated in this slot. The locomotive returns the Status in the control block of the header and Position in the data block. The Locomotive will now know I have an error and will call in the problem. MY controller will function to the best of its abilities less whatever has failed.

EXAMPLE 4

A single locomotive has approached a single intersection and now receives and acknowledge. This assumes the Master failed but the SLAVE functioned. The intersection has been programmed and arbitrated and is fully set up for position, housekeeping and acknowledge. A look at the beacon determines if it is time to respond or not. If not we wait and watch the locomotive approach and verify proper vectors and so on. When the Locomotive is 45±1 seconds it is time to ac as follows. In time slot T3 the MASTER did not transmit—it has failed. The SLAVE and advanced controllers know there is a problem but do nothing. During the next timing window slot T3 the MASTER again does not transmit—it has failed. The SLAVE and advanced controllers know there is a problem but do nothing. During the third timing window slot T3 the MASTER again does not transmit—it has failed. The SLAVE and advanced controllers know there is a problem. The SLAVE will now set itself to the MASTER housekeeping slot and act as a Master. In the next timing interval the SLAVE is now a MASTER and it will transmit control command 0x02—Turn On—with 2-5 seconds. The MASTER will immediately know if the other devices function and will respond accordingly. By 30 seconds from arrival the MASTER must acknowledge the locomotive and will reply in the acknowledge slot T4 as arbitrated in this slot. A return of my Status in the control block of the header and Position in the data block. The Locomotive will now know there is a failure or error and will call in the problem. The master controller will function to the best of its abilities less whatever has failed.

EXAMPLE 5

A single locomotive is approaching an equipped intersection. When the controller responds with an Ack, the CRC for the map is forwarded as well. The Locomotive will look at the acknowledge location of the and CRC. Then it will calculate its CRC and verify both databases match. If there is a CRC error calculated by the locomotive the following occurs. During the next timing cycle the locomotive will request the token if it is open. Once the locomotive receives the token it will dump the crossings coordinates and the 7 controllers it has in memory along with date and CRC data. Now the Crossing will updated or any part of the mapping, which is out of date. During the next timing cycle the controller will transmit its status for the locomotive to verify CRC.

Although the preferred embodiment has been described with reference to a railroad crossing warning system, it should be understood that the present invention is equally applicable to a variety of vehicle collision/crossing warning systems, including: emergency vehicle traffic light override systems, automobile navigation systems, airport and construction zone vehicle tracking systems and other navigational control and warning systems.

One example of such an application is use of the autonomous collision/crossing warning system as part of a bus warning system. There are approximately 9000 locomotives in the United States. If a C3 low cost broadcast beacon in accordance with the preferred communication protocol is placed on every locomotive and a C3 receiver/transmitter MASTER module were to be placed on each vehicle such as a bus for purposes of warning of the proximity or potential for collision with a locomotive, a simple trajectory algorithm could warn as follows:

Using past and present position, heading and velocity information a vehicle, such as a bus, would map its most likely future course.

Using past and present position, heading and velocity information received from the locomotive beacon a vehicle, such as a bus, would map the locomotives most likely future position The vehicles intelligent collision avoidance would then give warnings such as: locomotive in nearby proximity, approaching but no projected collision and caution—paths cross.

Another example of such an application is use of the autonomous collision/crossing warning system as part of a warning system on emergency vehicles.

There are multiple collisions every year between safety vehicles and commuters at lighted intersections. When a safety vehicle approaches an intersection they often slow and cross hoping either commuters saw and heard them or the safety vehicle sees the commuter. This methodology is flawed, as a historical study of intersection collisions will show. If a C3 Beacon is placed on a safety vehicle and a C3 MASTER module is placed at the crossing controller, the MASTER module can use the intelligent software as previously described to map future positions and vehicle approaches allowing for signal changes to efficiently and safely pass emergency vehicles through intersections. This approach will also allow for safety vehicles to know of each other and for an intersection to decide which vehicle is given priority if two or more are approaching at different approaches. In this final case where two safety vehicles approach unknown to each other, the intelligent software would warn of an impending collision.

As can be seen, once an autonomous collision/crossing warning system of the present invention is installed on locomotives and then buses and safety vehicles, the system can be provided with a comprehensive, educative, alert and decision making communications software arrangement which allowing for:

If the intersection needs protection there is an efficient low cost warning system utilizing C3 MASTER, SLAVE and XA technologies.

If the crossing exists or is absent, the bus will know of the locomotive from its beacon.

If safety vehicles such as ambulances, fire trucks or police vehicles, have an installed MASTER it will know of the locomotives approach and be able to inform the driver of delays and let the driver select alternate paths to its destination around the blocked crossing.

If the safety vehicles above were beacons as well, they could not only warn other safety vehicles of their approach they could safely and inexpensively tell lighted road crossings of their approach through the beacon. The crossing would hear with its MASTER allowing for lights to change and pass the vehicle through safely and efficiently.

Another application of the beacon communication network of the present invention is in collision/crossing warning systems for maritime applications. By installing a C3 MASTER at each buoy or other waterway object of interest and C3 Beacons on each vessel, the buoy could listen to approach information and predict proper passage or potential errors. This potential error could then be used to alert the crew of their error and potential future problems. Expounding this farther, the same intelligent projection and collision software could be used to warn crews of the presence of other ships and impending problems yet to come.

In the various embodiments of the present invention, TDMA is used to control the radio network and for time synchronization through the use of precision timing derived from a Global Positioning Satellite System on both locomotive and crossing systems. This system permits several devices to actively communicate in the area of a single device and not interfere with that device. This is particularly useful when the system is deployed in the vicinity of several devices using a shared radio frequency. This approach also enables inter-crossing communications without interference from/to nearby crossings. Dual power radio transceivers, for inter-crossing communications, minimize the load on the solar power systems to maximize battery life. Low power transmissions (<100 mw) are used for inter-crossing communications while higher power transmissions (2 watts) are used for MAYDAY broadcasts.

Network control is based on timeslot network transmissions such that various warning systems 10 crossing units only need be "AWAKE" during certain time intervals, i.e. every 4 seconds. This permits 3 seconds sleep out of every 4 seconds (less than 25% duty cycle) to maximize battery power. The various embodiments of the present invention also provide two-way positive confirmation wireless communications links between locomotive and crossing indicating activation, deactivation and status of data; although such a return acknowledgement from the stationary controller is not necessary. In dealing with multiple locomotives, individual crossing master controllers can screen out locomotives, which are in the area, but on different courses that will not intersect the crossing. Further, automatic fault notification of malfunctioning crossings detected by the locomotives is communicated via Cell Phone Modem/Pager. Locomotive controllers are also capable of collecting data and storing such in non-volatile memory for post processing on a PC. Collected data is also transmitted via cell phone at the end of the day.

In a related embodiment, system 10 utilizes USCG (United States Coast Guard) DGPS Broadcast data when available or it can fall back on local generated, pseudo range, error data from the Master-crossing controller. This data is included in transmissions from the Master-crossing controller to the locomotive and will be used by the locomotive GPS receiver to correct for range errors in its receiver, if needed. The Great Circle Navigation method is used in all navigation calculations for increased accuracy. Further, minimum power "sleep mode" is included on all solar powered devices for power conservation. Accurately timed, wake up for communications synchronization, is maintained by all devices with a precision time base source at each device. Corrections are sent from Master crossing controller periodically to correct for time base drift. All time information is obtained via DGPS and is accurate to microseconds. The communications system design allows generous margins for time errors before system performance is affected.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

The invention claimed is:

1. An autonomous vehicle railroad crossing warning system comprising:

a plurality of crossing controllers located in proximity to at least one railroad crossing, at least one of the plurality of crossing controllers located in proximity to the at least one railroad crossing being associated with a stationary warning device located at the at least one railroad crossing;

a train controller associated with a train traveling along a rail line through the at least one railroad crossing, and a vehicle controller associated with a vehicle located in proximity to the at least one railroad crossing;

wherein each train controller, vehicle controller, and crossing controller includes a radio transceiver configured to utilize a single frequency time domain multiplexed (TDM) radio communication protocol, that is a connectionless user datagram protocol (UDP);

wherein at least one of the plurality of crossing controllers located in proximity to the railroad crossing includes a global positioning system (GPS) receiver configured to provide the radio transmitter with GPS clock synchronization to broadcast messages to at least one of: the train controllers, vehicle controllers, and the plurality of crossing controllers, within range of the radio transmitter in the warning system; and wherein at least one of the plurality of crossing controllers located in proximity to the at least one railroad crossing is configured to receive and process data from broadcast messages from a multiplicity of the train controllers and the vehicle controllers in a vicinity of the at least one railroad crossing and is configured to screen out at least one of the train controllers and the vehicle controllers on a course that will not intersect the at least one railroad crossing.

2. The autonomous warning system of claim 1 wherein each controller is configured to utilize a time slot arbitration relying on the GPS clock synchronization to determine when to broadcast messages from that controller.

3. The autonomous warning system of claim 1 wherein the train controller for each train and the vehicle controller for each vehicle is configured to periodically and autonomously broadcast messages which include data for their respective heading, speed and location.

4. The autonomous warning system of claim 3 wherein the crossing controller for each stationary warning device is configured to determine whether to activate the associated warning device based on calculating a position of at least one of the train and the vehicle relative to the stationary warning device based on data in the broadcast message of at least one of the train controller and the vehicle controller.

5. The autonomous warning system of claim 3 wherein the controller for at least one of the train and the vehicle is configured to determine whether to activate an associated warning device based on calculating a course of at least one other of at least one of the train and the vehicle relative to a course of the at least one of the train and the vehicle for that controller based on data in the broadcast messages for the controller associated with the at least one other of at least one of the train and the vehicle.

6. An autonomous vehicle railroad crossing warning system for a plurality of components associated with at least one railroad crossing in the railroad crossing warning system, the components including vehicles and stationary objects, the railroad crossing warning system comprising:

a plurality of controllers located in proximity to at least one railroad crossing, each controller operably associated with one of the plurality of components in the warning system and including a radio transceiver configured to utilize a single frequency time domain multiplexed (TDM) radio communication protocol, and a global positioning system (GPS) receiver configured to provide the radio transmitter with GPS clock synchronization to broadcast messages to at least some of the components in the warning system including at least one train traveling along a rail line through the at least one railroad crossing and at least one warning device located at the at least one railroad crossing, wherein each controller is configured to utilize data from a broadcast message of nearby components to autonomously construct an adaptive localized map representing at least a location of nearby stationary components of interest within the warning system for the controller associated with that component, and wherein the controller associated with the at least one train is configured to collect and propagate at least a portion of the adaptive localized map to any controller requiring updated data when the at least one train is within range of the radio transceiver of the controller.

7. The autonomous warning system of claim 6 wherein the broadcast messages from each stationary controller selectively include representations of the adaptive localized map in order to propagate and update the location of nearby stationary components.

8. An autonomous vehicle railroad crossing warning system comprising:

a master controller that is stationary and located in proximity to at least one railroad crossing and includes a global positioning system (GPS) receiver, at least one slave controller without a global positioning system (GPS) receiver that is stationary and located in proximity to the at least one railroad crossing, at least one vehicle controller associated with a vehicle in proximity to the railroad crossing, at least one train controller associated with a train traveling along a rail line through the at least one railroad crossing, and at least one warning device located at the at least one railroad crossing;

wherein each master controller, slave controller, vehicle controller, and train controller includes a radio transceiver that configured to utilize a single frequency time domain multiplexed (TDM) radio communication protocol;

wherein the master controller is configured to provide the radio transmitter with GPS clock synchronization to broadcast calibration messages to the at least one slave controller;

wherein the master controller and the at least one slave controller are deployed as a plurality of self-powered units each equipped to receive broadcast messages over the TDM radio communication protocol and configured to communicate with the at least one train controller, the at least one vehicle controllers, and the other units by a low power radio frequency (RF) channel; and wherein communications on the low power RF channel are synchronized by the master controller with periodic GPS time stamps such that no GPS operations are required by any slave controller.

9. The autonomous warning system of claim 8 wherein the stationary self-powered units are configured to operate on a low power RF channel on a low duty cycle operation to decrease power consumption among the stationary self-powered units.

10. The autonomous warning system of claim 8 wherein phase and amplitude information of broadcast messages received by each of the units is transmitted over the low power RF channel and used to differentiate valid broadcast messages from extraneous triggers.

* * * * *